US010800647B2

(12) United States Patent
Borg

(10) Patent No.: US 10,800,647 B2
(45) Date of Patent: Oct. 13, 2020

(54) PNEUMATIC OPERATED TANK FILLING SYSTEM AND RELATED METHOD OF USE

(71) Applicant: Evergreen Environmental Services, LLC, La Porte, TX (US)

(72) Inventor: Paul Borg, Houston, TX (US)

(73) Assignee: Evergreen Environmental Services, LLC, La Porte, TX (US)

( * ) Notice: Subject to any disclaimer, the term of this patent is extended or adjusted under 35 U.S.C. 154(b) by 278 days.

(21) Appl. No.: 15/965,055

(22) Filed: Apr. 27, 2018

(65) Prior Publication Data

US 2018/0312391 A1 Nov. 1, 2018

Related U.S. Application Data

(60) Provisional application No. 62/492,479, filed on May 1, 2017.

(51) Int. Cl.
*B67D 7/36* (2010.01)
*B67D 7/32* (2010.01)
(Continued)

(52) U.S. Cl.
CPC ..... *B67D 7/365* (2013.01); *B67D 7/04* (2013.01); *B67D 7/3218* (2013.01);
(Continued)

(58) Field of Classification Search
CPC ..... B67D 7/365; B67D 7/04; B67D 7/3218; B67D 7/3272; B67D 7/3263; B67D 7/845; B67D 7/78
See application file for complete search history.

(56) References Cited

U.S. PATENT DOCUMENTS 3,662,792 A 5/1972 Grant
3,807,899 A 4/1974 Ward et al.
(Continued)

FOREIGN PATENT DOCUMENTS

CA 2507101 11/2005
FR 2359346 2/1978
(Continued)

OTHER PUBLICATIONS

Verma, S et al, Design Options for Overfill Prevention for Aboveground Storage Tanks, 10th Global Congress on Process Safety, GCPS 2014, Mar. 30, 2014.
(Continued)

*Primary Examiner* — Marina A Tietjen
(74) *Attorney, Agent, or Firm* — Warner Norcross + Judd, LLP

(57) ABSTRACT

A system and related method of filling tanks is provided so that tanks do not attain an overfill condition and/or so the tanks are filled to a maximum specified capacity. The system includes an adjustable float switch having a float configured to float in liquid that is filled into a trailer tanker, a mix tank, a frac tank, a storage tank and a variety of other tanks. The float can be set so that when the liquid attains a maximum level and associated volume, the float switch opens so that pressurized air can be communicated from it to a pneumatically actuated tanker valve disposed in a supply line. This shuts off the flow of liquid through the supply line and into the tank. The system can be operable in a various modes, such as a filling mode, a filled mode, a manual emergency shutoff mode and/or a manual reset mode.

17 Claims, 14 Drawing Sheets

(51) Int. Cl.
*B67D 7/04* (2010.01)
*B67D 7/78* (2010.01)
*B67D 7/84* (2010.01)

(52) U.S. Cl.
CPC ..... *B67D 7/3263* (2013.01); *B67D 7/3272* (2013.01); *B67D 7/78* (2013.01); *B67D 7/845* (2013.01)

(56) References Cited

U.S. PATENT DOCUMENTS 3,937,084 A * 2/1976 May ..... G01F 23/665 73/309
4,091,846 A * 5/1978 Legleiter ..... B60P 3/224 137/390
4,129,038 A * 12/1978 Leutenegger ..... B67D 7/367 73/307
4,948,340 A 8/1990 Solomon et al.
5,007,450 A 4/1991 Babb et al.
5,660,214 A 8/1997 Pettesch
6,247,492 B1 6/2001 Stuart
8,955,561 B2 * 2/2015 Mitrovich ..... B65B 3/04 141/198
2006/0169325 A1 8/2006 Schmitz et al.
2013/0032248 A1 * 2/2013 Mitrovich ..... B67D 7/005 141/198

FOREIGN PATENT DOCUMENTS

FR 2395444 1/1979
GB 380403 9/1932
GB 2402931 12/2004

OTHER PUBLICATIONS

Overtill Prevention: Best Management Practices for Your Underground Storage Tank, EPA Office of Underground Storage Tanks, Jul. 2012.
Spill and Overfill Control, North Dakota UST Operator Training Program, Dec. 16, 2016.
Pneumatic Push Button Valves-Manually Operated, downloaded from http://www.thepneumaticscompany.com/products/pneumatic-push-button-valves on Apr. 17, 2017.
Korane, KJ, Taking the Guesswork Out of Pneumatic Control, downloaded from http://machinedesign.com/pneumatics/taking-guesswork-out-pneumatic-control on Apr. 17, 2017, published Apr. 6, 2000.

* cited by examiner

PNEUMATIC OPERATED TANK FILLING SYSTEM AND RELATED METHOD OF USE

BACKGROUND OF THE INVENTION

The present invention relates to tank filling devices, and more particularly to a pneumatically operated tank capacity maximization and/or overfill protection device, and related methods.

There are many types of containers, for example, tanks, that are used to transport and/or store a wide variety of liquids, such as petroleum based liquids, crude oil, gasoline, kerosene, waste oil, oil and water mixtures, petroleum contaminated liquids and other liquids. The tanks can be stationary or mobile. Where mobile, the tank can be in the form of a trailer tanker, having a rolling chassis with wheels. The trailer tanker can be configured for hauling with a semi-truck or tractor. With this construction, the trailer tanker can be transported from one site to the next to collect and/or dispose of the liquid. Where stationary, the tank can be a temporarily placed type of tank, for example a frac tank, that is disposed at a jobsite to collect waste liquids, frequently a mixture of petroleum and a solution such as water, at the jobsite. The frac tanks can be loaded and unloaded multiple times depending on the processing of the liquid.

Because such tanks are typically filled with a potentially hazardous or contamination prone liquid, it is an objective of most owners and operators in the industry to prevent overfill of the tank. An overfill event can result in a spill of petroleum laden liquids, such as oil and gasoline, or other hazardous materials. As can be imagined, hazardous materials can be burdensome and expensive to clean up. Furthermore, the spill can potentially harm the environment if the liquid is spilled in a significant amount or in a location that is environmentally sensitive. Where overfill is not detected for some time, there can be extensive ground contamination. Moreover, most cleanup operations must stop upon the overfill event, and additional costs are added to the project.

Several devices have been installed on tanks, both stationary and mobile, in attempts to address overfill. Some tanks and trailer tankers are equipped with sight gauges that an operator must observe to visually identify when the tank is approaching an overfill condition. Such sight gauges are, however, susceptible to human error. This is compounded if an operator walks away from the tank while the loading process is proceeding. In this case, if the sight gauge is not monitored by someone else, the tank has an increased probability of overfill. Other systems use digital gauges, some connected to siren alarms, to provide an operator with a numeric reading of the percentage of overfill or the number of gallons in the tank being filled. Many times however, these devices are electronic and can be prone to failure, particularly when installed on trailer tankers that traverse bumpy roads and rough terrain that is common in loading areas, tank yards and oil fields. Further, even in cases where a gauge does not fail, it still can provide incorrect information due to its movement during transportation. In some cases, the digital and/or sight gauges also can be inadvertently positioned so that they cannot be easily observed. Accordingly, this makes it more difficult for an operator to monitor the status of the filling operation.

Some mobile tanks, such as trailer tankers, face other issues in addition to overfill. For example, many times trailer tankers are utilized on a jobsite to transport liquids. If there are significant volumes of liquid, then multiple trailer tankers and associated semi-trucks are utilized. Over time, this can result in tens if not hundreds of trips performed by various trailer tankers. Under current practice, the filling conditions or fill status is monitored by an operator. Typically, the operator will position themselves on top of the tanker adjacent a top opening of the tanker. The operator will extend a tape measure into the tanker to measure the fill level. Many times, the configuration or shape of the trailer tanks can vary. Therefore the tape measure frequently does not provide an accurate reading corresponding to the actual volume of liquid in the particular trailer tanker. Out of caution, the trailer tankers frequently are under filled. Thus, the trailer tanker capacity is rarely maximized. In other words, trailer tankers transport substantially less than they are capable of transporting. As a result, more trailer tankers are utilized and more trips are performed than are needed. This leads to added expense in wasted man hours and fuel for the trucks because the trailer tankers are not adequately filled.

Accordingly, there remains room for improvement in the field of tank filling to decrease the incidence of overfills and to improve the filling of tanks to capacity.

SUMMARY OF THE INVENTION

A system and related method of filling tanks is provided so that the tanks do not attain an overfill condition and/or so that the tanks are filled to a maximum specified capacity.

In one embodiment, the system includes an adjustable float switch having a float configured to float in liquid that is filled into a container such as a tank, which can be mobile and/or stationary. The float can be set so that when the liquid attains a maximum capacity in the tank, the float opens the float switch so that pressurized air can be communicated from the float switch to a pneumatically actuated tank valve disposed in a supply line.

In a further embodiment, the system is operable in a filled mode in which the tank has been filled to a maximum capacity such that a float floats in the liquid being filled into the tank. As a result, pressurized air is cut off to a normally closed tank valve that is disposed in the supply line upstream from the tank. As a result, when the tank valve closes, liquid no longer flows through the supply line into the tank. Thus, the filling operation stops.

In still another embodiment, the system is operable in a filling mode in which the tank is being filled by liquid from a supply line but has not reached a maximum capacity and/or overfill condition. In this case, the float switch remains closed so that pressurized air can still be communicated to the tank valve to keep it open, thereby allowing liquid to flow through the supply line into the tank.

In even another embodiment, the system is operable in a reset mode. The system can include a first air mechanical valve that is normally closed. The first air mechanical valve can include a manual actuator, such as a button, toggle, switch, lever, dial or the like which is configured to be manually engaged by a human operator. When so engaged, the first air mechanical valve opens so that pressurized air can be selectively communicated to the tanker valve, in which case the pressurized air opens the tank valve and allows liquid to flow through to the supply line into the tank.

In yet another embodiment, the system is operable in a manual shut off mode. The system can include a second air mechanical valve that is normally closed. The second air mechanical valve can include a manual actuator configured to be manually engaged by a human operator. When so engaged, the second air mechanical valve opens so that it ceases communication of the pressurized air to the normally closed tank valve, in which case the tank valve closes, and prevents liquid from flowing through the supply line into the tank.

In a further embodiment, a method of preventing overfill of a tank is provided. The method can include providing a normally closed float switch on a first tank; setting a float of the float switch at a first level corresponding to an overfill or preselected capacity; providing an air operated pump; providing an air pressure compressor; engaging the air compressor so that pressurized air from the air compressor runs the air operated pump to pump liquid through a supply line into the first tank; continuing to fill the tank with the liquid until the liquid attains an overfill capacity of the first tank so that the float trips the float switch, thereby opening the float switch so that pressurized air can be communicated to discontinue pressurized aid conveyed to the air operated pump from the air compressor, optionally so that the air operated pump ceases pumping liquid through the supply line into the first tank.

In still a further embodiment, the method can include manually actuating a second air mechanical valve in fluid communication with the air compressor and the air operated pump, so that the air compressor ceases communication of the pressurized air to the air operated pump, whereby liquid ceases flowing through the supply line and into the first tank.

In still yet a further embodiment, the method can include manually actuating a first air mechanical valve in fluid communication with the air compressor and the air operated pump, so that the first air mechanical valve causes communication of the pressurized air to the air operated pump, thereby actuating the pump again so that liquid flows through the supply line into the first tank.

In even a further embodiment, the method can include temporarily installing a supply line on a first tank to be filled; including in the supply line and/or at the interface with the tank a normally closed pneumatically actuated tank valve configured to open when pressurized air is introduced to the tank valve; and communicating pressurized air to open the tank valve to allow liquid to flow through the supply line, through the tank valve and into the tank, thereby at least partially filling the first tank.

In yet a further embodiment, the method can include filling a petroleum based liquid into a tanker to the tanker's maximum capacity. The method can include calculating the maximum capacity, for example, in weight, of a trailer tanker; identifying a corresponding level of liquid in the trailer tanker tank corresponding to a particular maximum capacity unique to that trailer tanker; installing an adjustable float switch in an uppermost opening associated with the trailer tanker; extending a down tube, which has a float movably disposed therein, downward, past an upper tanker wall and into an internal volume of the trailer tanker until the float is set at the predetermined level; filling the trailer tanker with a liquid via the supply line having a tank valve to the predetermined level; closing the tank valve when the float is tripped by the predetermined level so that liquid no longer flows to the supply line into the trailer tanker. When this occurs, the trailer tanker can be filled to its maximum capacity, optionally corresponding to the maximum weight capacity of the trailer tanker, without wasting any volume inside the trailer tanker.

In still a further embodiment, the method can include providing a plurality of trailer tankers in succession; installing the float switch and float in each of the trailer tankers sequentially; installing the tank valve in a supply line and coupling the supply line to each of the trailer tankers sequentially while the float switch is installed on a respective trailer tanker; filling each of the trailer tanker sequentially to a maximum capacity designated for each of the individual trailer tankers; and actuating the float switch when a respective trailer tanker reaches maximum capacity, whereby the float switch actuates the tank valve to cease flow through the supply line to the trailer tanker, in which case the trailer tanker ceases being filled.

In still yet a further embodiment, the method can include installing multiple float switches in multiple tanks, for example mix tanks; coupling all of the multiple float switches to a common air circuit; coupling the air circuit to a tank valve joined with a supply line that is further coupled to each of the multiple tanks; filling one or more of the tanks to a predetermined level, whereby the actuation of one or more of the float switches in a particular tank filled to a predetermined liquid level shuts the tank valve so that liquid no longer flows into any of the respective tanks.

The current embodiments of the apparatus and related methods provide benefits in overfill protection and the attainment of maximum tank capacity that previously have been unachievable. For example, where the system is pneumatically operated, there is a decreased likelihood of spark, which can reduce the likelihood of explosions when the system and methods are utilized to load petroleum-based products in tanks. With the automatic overfill protection, tank overfill is virtually eliminated. In turn, this can avoid environmental incidents, can ensure an efficient cleanup operation and can avoid additional costs to various projects. When trailer tankers are loaded using the system and methods, an extra operator on the truck checking the level of liquid in the trailer tanker can be avoided. The system and methods also can avoid excessive emissions during loading, which can eliminate the need for breathing air equipment for operators filling a particular trailer tanker or other tank. Generally, the systems and methods can reduce on-site labor and thus lower operating costs for tank fill projects. Further, with the system and methods herein, a trailer tanker can be filled to a precise maximum capacity each time the trailer tanker is filled, in which case the trailer tanker can be used with maximum efficiency to haul the subject liquid.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
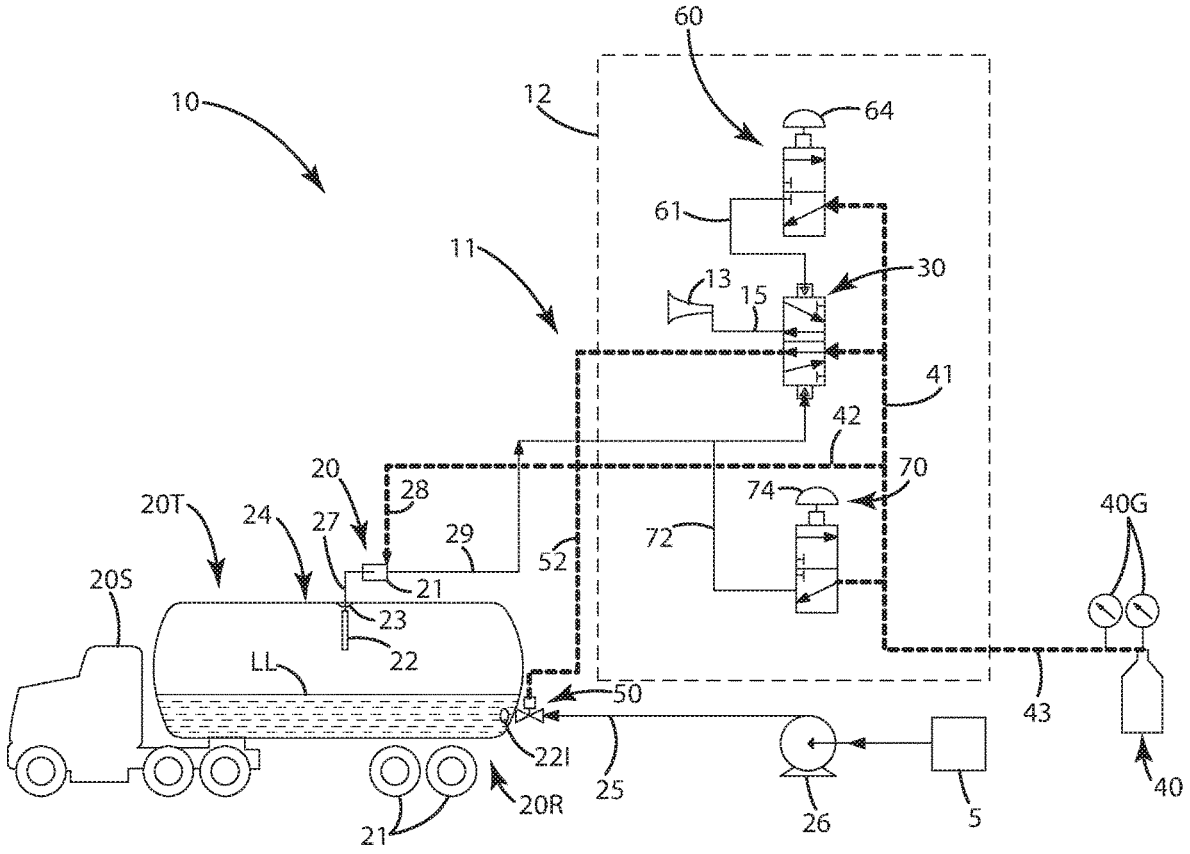
FIG. 1 is a schematic diagram of the pneumatically operated system of a current embodiment utilized in connection with a trailer tanker with the system in a filling mode.

A current embodiment of a pneumatic overfill protection or capacity maximization system is illustrated in FIGS. 1-4C, and generally designated 10. The system and methods of this embodiment can be utilized in connection with the transfer of petroleum based liquids to and from vessels, trailer tankers, frac tanks, mixed tanks, disposal tanks, recycle tanks, storage tanks and the like, all of which may generally be described as tanks herein. The petroleum-based liquids that are transferred can be any liquid including petroleum materials or petrochemicals, for example oil, an oil/water mix, frac liquids, kerosene, gasoline, oil byproducts, refinery waste materials, as well as cleaning liquids and other hazardous and/or toxic liquids.

As described further below, the system 10 can be used to prevent overfill of a tank. As used herein, overfill refers to a condition where a particular tank is at or about to experience an overfill condition where liquid escapes the tank inadvertently through an opening in the tank, thereby having the potential to contaminate the environment or otherwise create a cleanup problem. The system also can be used to fill tanks to a maximum capacity. This maximum capacity can correspond to the full available volume of material based on the maximum net weight available per load in a tank, such as a trailer tanker. Generally this weight per unit mode will vary depending on the load weight rating of particular trailer tanker. A description of how the maximum capacity can be determined for a particular liquid and a particular trailer tanker or other tank is described further below. The system can further be used to fill a tank to a first capacity, second capacity, third capacity or some other capacity, which can be a maximum capacity as described above, or some other capacity that is suitable for a particular application, such as a half full tank capacity, or some other capacity calculated or desired to be loaded into a tank.

With reference to FIGS. 1-4C, a current embodiment of the system 10 will now be described in connection with trailer tanker 20T being filled to a maximum capacity in a safe manner. To begin, the trailer tanker 20T can be joined with a semi-truck 20S or other rig for pulling the trailer tanker along a surface such as a road. As illustrated, the trailer tanker can include wheels 21 mounted on one or more axles in the rear 20R for rolling support. The trailer tanker also can include a lower trailer tanker inlet 221 which is generally disposed on the rear 20R of the truck. Of course, other cases can be disposed in other locations along the length of the trailer tanker. The trailer tanker also can include an upper trailer tanker port or vent 23 that forms an opening on upper wall 24 of the trailer tanker.

With the system, the trailer tanker 20T can be filled via a supply line 25 coupled to the lower trailer tanker inlet 22. The supply line 25 can be manually coupled to the lower trailer tanker inlet 221 by an operator attending to the system and/or the trailer tanker. The supply line is in further selective fluid communication with a source 5 of the liquid, for example a petroleum based liquid, which can be fed through the supply line into the trailer tanker 20T. To provide this flow of the liquid into the trailer tanker, a pump 26 can be provided. This pump generally pumps the liquid so that it flows through the supply line 25, metered and/or controlled by a tank valve 50 as described further below. The pump can be a combustion pump which includes a diesel pump, a gas pump, a propane pump, a methane pump or other types of pumps. In some cases however, the combustion pump can be replaced with a different type of pump, such as an air operated pump, run via pressurized air from an air compressor.

As shown in FIG. 1, the system 10 can generally include a float switch 20 and air circuit 11, which is comprised of various conduits that can convey pressurized fluids, such as pressurized air, therethrough into the various components of the system 10, the tank valve 50, a source of pressurized fluid or air 40, and an optional housing 12 to house, conceal and generally protect a system of a first air mechanical valve 60, a second air mechanical valve 70, an air pilot valve 30 and optional audible alarm, such as an air horn 13, which operates in the system on exhaust air and emits an audible warning for several seconds as described below.

Figure 2:
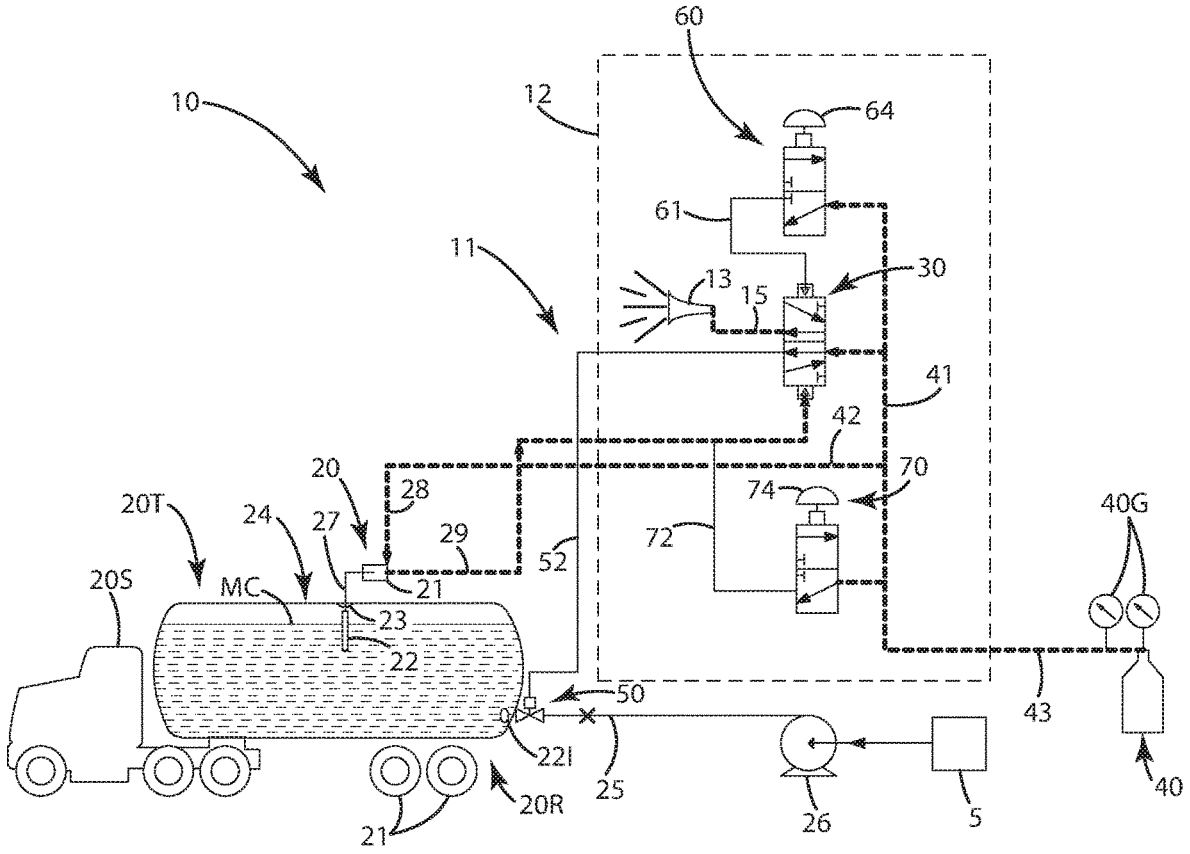
FIG. 2 is a schematic diagram of the system utilized in connection with the trailer tanker with the system in an automatic float switch shut off mode, or filled mode.

The various components of the system 10 will now be described in further detail, along with the various modes of operation. To begin, the float switch 20 can include a pneumatic float valve, modified to include an adjustable, vertical float arm. The float switch 20 can include a pneumatically operated float valve 21 that is coupled to a float 22 via an adjustable arm 27. The float switch, in general, can include a normally closed pneumatic float valve 21. The adjustable arm can be extended and retracted, or otherwise increased in length or decreased in length so as to set the float 22 at a predetermined liquid level inside the tank. This particular level can be set at, for example, a first capacity, such as a maximum capacity MC of the tank, or a level that corresponds to a potential overfill condition as described further below. Generally, the float switch 20 can be set up so that the float 22 remains above the liquid level LL shown in FIG. 1 when the tank is being filled, until a particular predetermined level is achieved, for example, a maximum capacity MC as shown in FIG. 2. When the liquid level associated with the maximum capacity is achieved, the float switch 20 operates as described below. One suitable pneumatic float valve is a normally closed pneumatic float valve, such as the magnetic float valve available from O'Keefe Controls Co. of Monroe, Conn.

Figure 4:
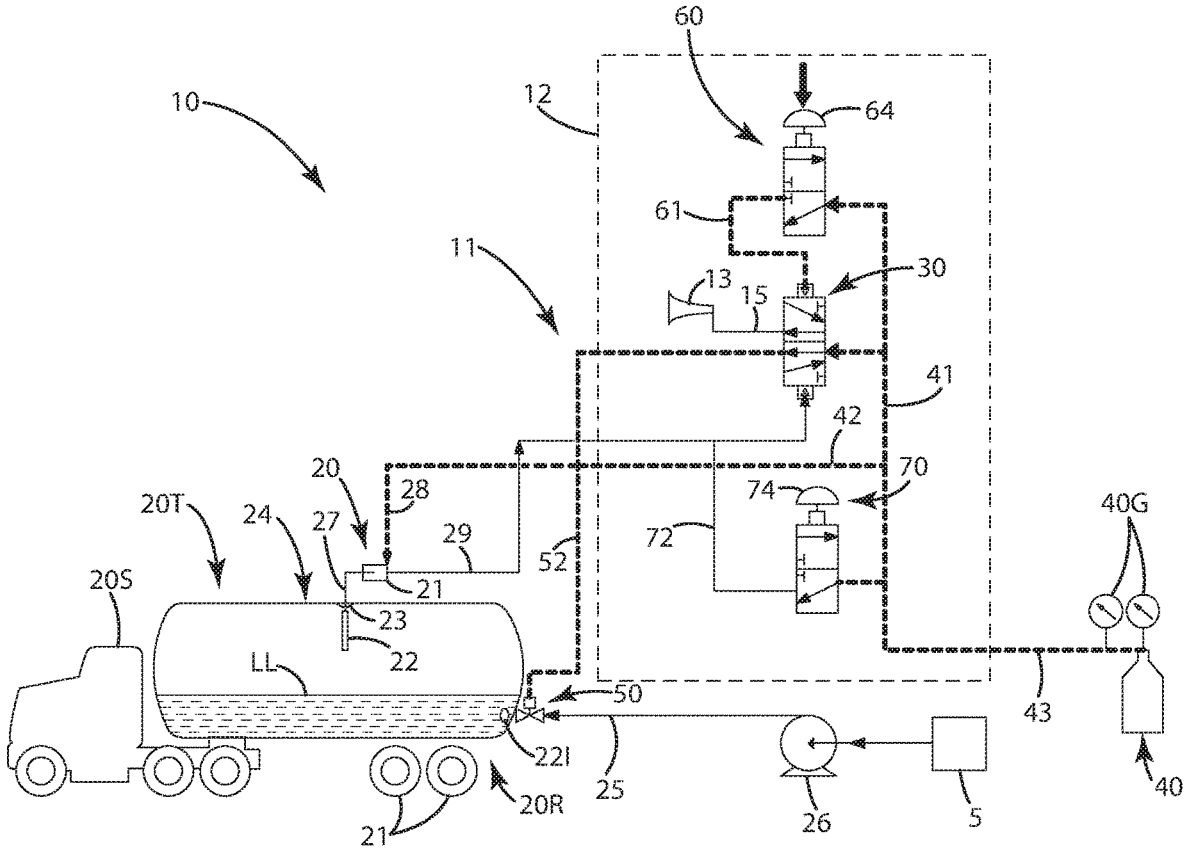
FIG. 4 is a schematic diagram of the system utilized in connection with the trailer tanker with the system in a manual reset mode, or reset mode.
Figure 4A:
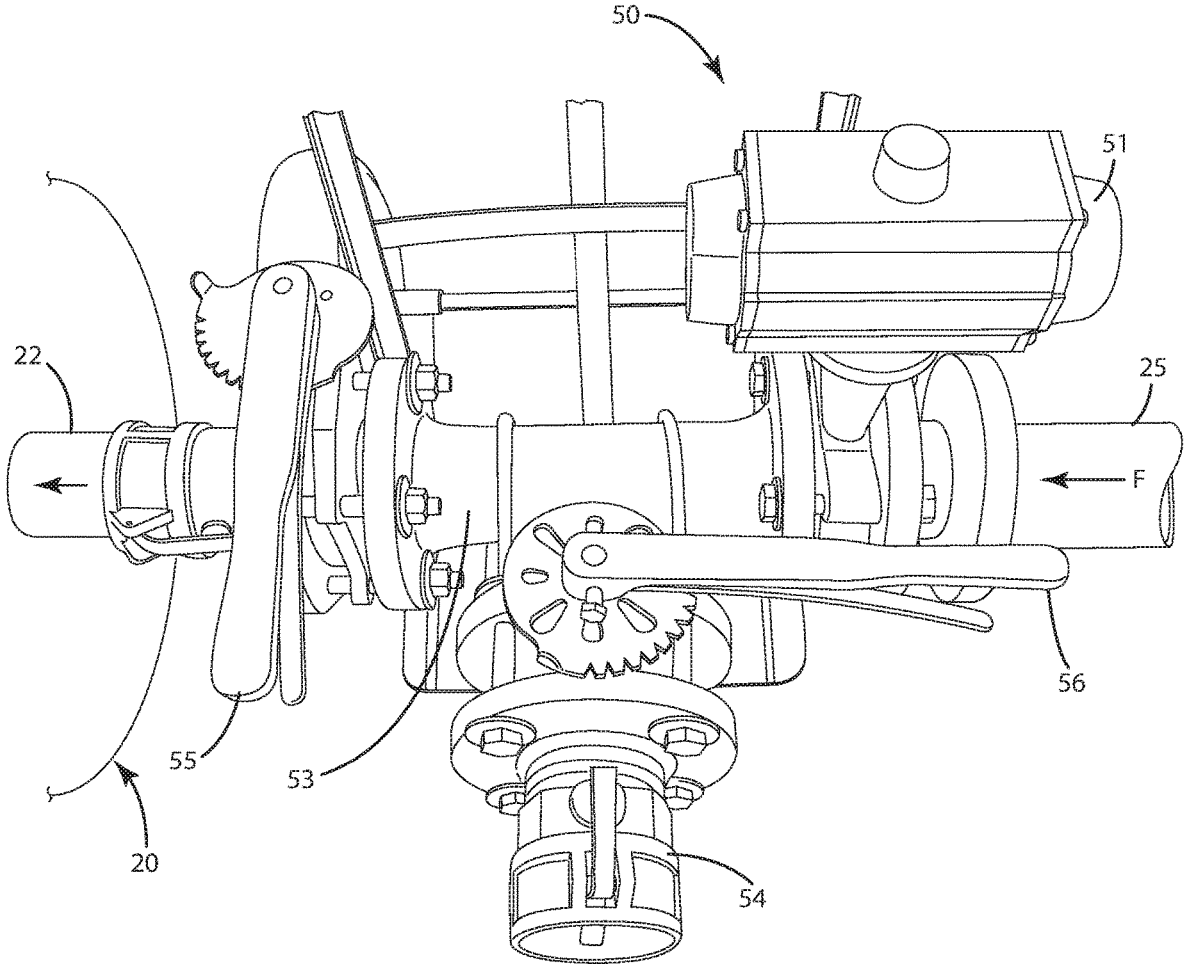
FIG. 4A is a perspective view of a pneumatically operated tank valve and other optional manual valves associated with a supply line to be joined with the trailer tanker.
Figure 4B:
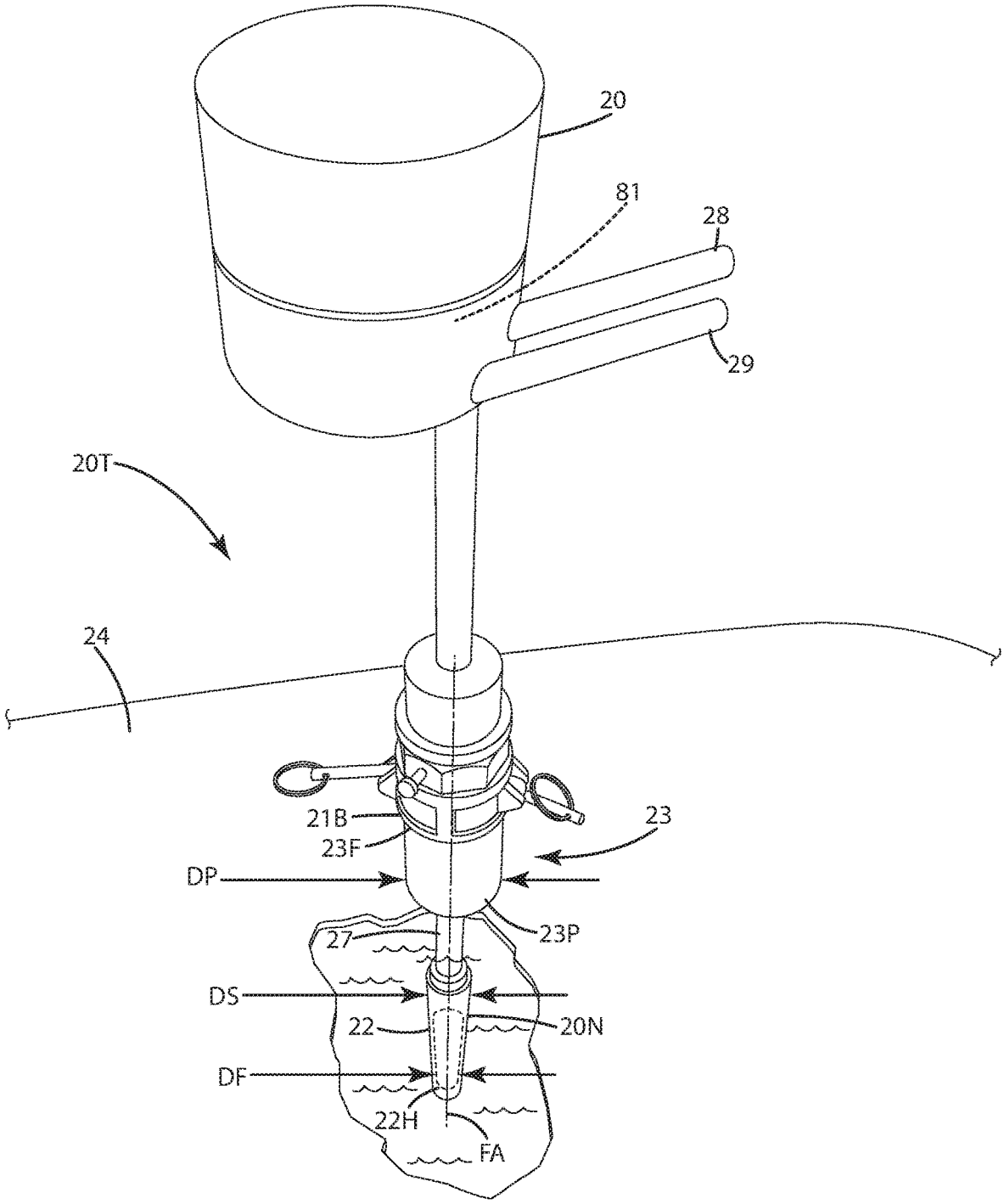
FIG. 4B is a perspective view of a float switch installed on a trailer tanker.

As shown in FIGS. 1 and 4B, the float switch 20 can include a float switch inlet air conduit 28 and a float switch outlet air conduit 29, which are connected to and therefore in fluid communication and capable of selectively transferring pressurized air to and from the air pilot valve 30. Where the float switch 20 includes a normally closed valve, unless the float actuates the float valve, pressurized air in the inlet air conduit 28 is not communicated to the outlet air conduit 29. Further as shown in FIG. 4B, the float switch 20 can include a sleeve 20N joined with and extending downward from the float valve 21. The sleeve 20N can be a tubular form and can slidably house the float 22 and the associated adjustable length float arm 27. The sleeve 20N can define a one or more holes 22H at its lower portion. These holes allow the float 22 to come into contact with liquid in the tank to for example a trailer tanker 20T upon filling of the tank to a particular level.

The float 22 can be an object that is at least partially buoyant in the liquid within which it is placed in a tank. For example, the float can be configured to physically float to some degree as it displaced the liquid in the tank. The float can be of an elongate, tubular shape, for example a cylindrical shape with rounded ends and can have a sealed interior compartment, optionally filled with a gas or a less dense material than the liquid within which the float is used. The float can have a diameter DF, taken transverse to a longitudinal axis FA of the float. The diameter can be less than the sleeve diameter DS described below. In some cases, the float can have a diameter of optionally less than 2 inches, further optionally less than 1.75 inches, even further optionally less than 1.5 inches, yet further optionally less than 1.25 inches, still further optionally about 1 inch.

The float 22 can be constructed from a variety of materials. These materials can be resistant to degradation in the chemicals and liquids within which the float is used. In some cases, the float can be constructed from a metal, such as stainless steel, or from a composite, such as carbon fiber, or polymer, optionally coated with a coating or cover to resist degradation. The float can come in a variety of weights, optionally less than 100 grams, further optionally less than 80 grams, yet further optionally less than 50 grams, still further optionally less than 25 grams, even further optionally less than 10 grams, still further optionally less than 5 grams.

Optionally, the float sleeve 20, also referred to as a down tube, can be tubular, and can include a sleeve diameter DS where the sleeve is cylindrical. The sleeve diameter DS can be less than an internal diameter DP of the port 23 of the tank. Accordingly, the sleeve 20N can be easily installed through the port 23. In some applications, the diameter DS of the sleeve 20N can be less than 2 inches, while in other applications, the diameter DS of the sleeve 20N can be less than 4 inches. Of course, the respective diameter DP of the port in these instances can be optionally 2 inches or greater, or further optionally 4 inches or greater.

Further optionally, as illustrated in FIG. 4B. The port 23 can include a connector pipe 23P that extends upward from the upper wall 24 of the tank 20T a preselected distance. The float switch 20 and in particular the float valve and its base 21B can be attached to and/or mounted atop this connector pipe 23P, and optionally to a flange 23F or other connector associated therewith. Of course, other configurations can be substituted for that of the float switch depending on the particular tank with which it is utilized. For example, the float switch can be utilized with a mix tank or frac tank as noted in the embodiments below. In those embodiments, the sleeves can be longer and larger, and can extend from the upper wall of the tank to below the float. The mounting mechanism also can be slightly different, depending on the upper port of those tanks.

The system shown in FIG. 1 also can include a source of pressurized air 40, which generally communicates the pressurized air to the various components of the pneumatic circuit 11. The source of pressurized air is joined with a pressurized air source conduit 43 having a first branch 41 and a second branch 42. The first branch can be in fluid communication with the air pilot valve 30 which is in further selective fluid communication with the tank valve 50. The second branch 42 can be in fluid communication with inlet air conduit 28 and thereby can convey pressurized air to the float switch 20 during normal operating conditions. Again, however because the float switch can be a normally closed pneumatic valve, the pressurized air is not communicated through the float switch 20 and its outlet air conduit 29 unless the float is adequately actuated.

As illustrated, the source of pressurized air 40 can be in the form of a portable bottle of pressurized air. It is to be noted that although the term of pressurized air or air is used herein, these terms can refer to any type of fluid, for example, pressurized gas, pressurized carbon dioxide, pressurized methane, pressurized CO2, pressurized nitrogen, pressurized ambient air, etc. The portable bottle of pressurized air can be mounted to the housing 12, a portable carrier (as described in the embodiments below) and/or can be a standalone unit. Generally the portable bottle can be filled with sufficient air pressure so that the system can be used to fill optionally at least 50 trailer tankers, further optionally at least 100 trailer tankers, even further optionally at least 250 trailer tankers. During these fills, pressurized air from the portable bottle repeatedly opens the tank valve multiple times in multiple cycles of the filling mode. The size of the bottle can be adjusted depending on the intended usage. The bottles can be outfitted with gauges 40G which can be used to measure the pressure remaining inside the bottle, as well as the pressure communicated to the conduit 43 and the remainder of the pneumatic circuit 11.

As mentioned above, the first branch 41 of the pressurized air source conduit 43 is in fluid communication with the air pilot valve 30. This fluid communication can be nonselective, that is, when the bottle 40 is opened and pressurized air is conveyed into the first branch, it maintains a constant pressure that does not vary significantly (until the bottle runs out of pressurized air) even when the other components of the system are actuated as described below. The air pilot valve 30 can be a five port four-way, solenoid valve. One suitable air pilot valve is the Bimba-Mead air pilot valve commercially available from Mead Fluid Dynamics of Chicago, Ill. The air pilot valve 30 can be in selective fluid communication with the air horn 13 and the first intermediate conduit 61 which is in further communication with the first air mechanical valve 60. The air pilot 30 valve can be in selective fluid communication with the float switch 20 via the float switch outlet conduit 29. The air pilot valve 30 can be in selective fluid communication with the tank valve 50 via the tank valve conduit 52 as described in further detail below in the various modes. The air pilot valve 30 can be normally closed, but can be opened via the actuation of the first air mechanical valve 60, and can be closed via the actuation of the second air mechanical valve 70 in an emergency or abnormal situation, and can be closed via the actuation of the float switch 20.

Figure 4C:
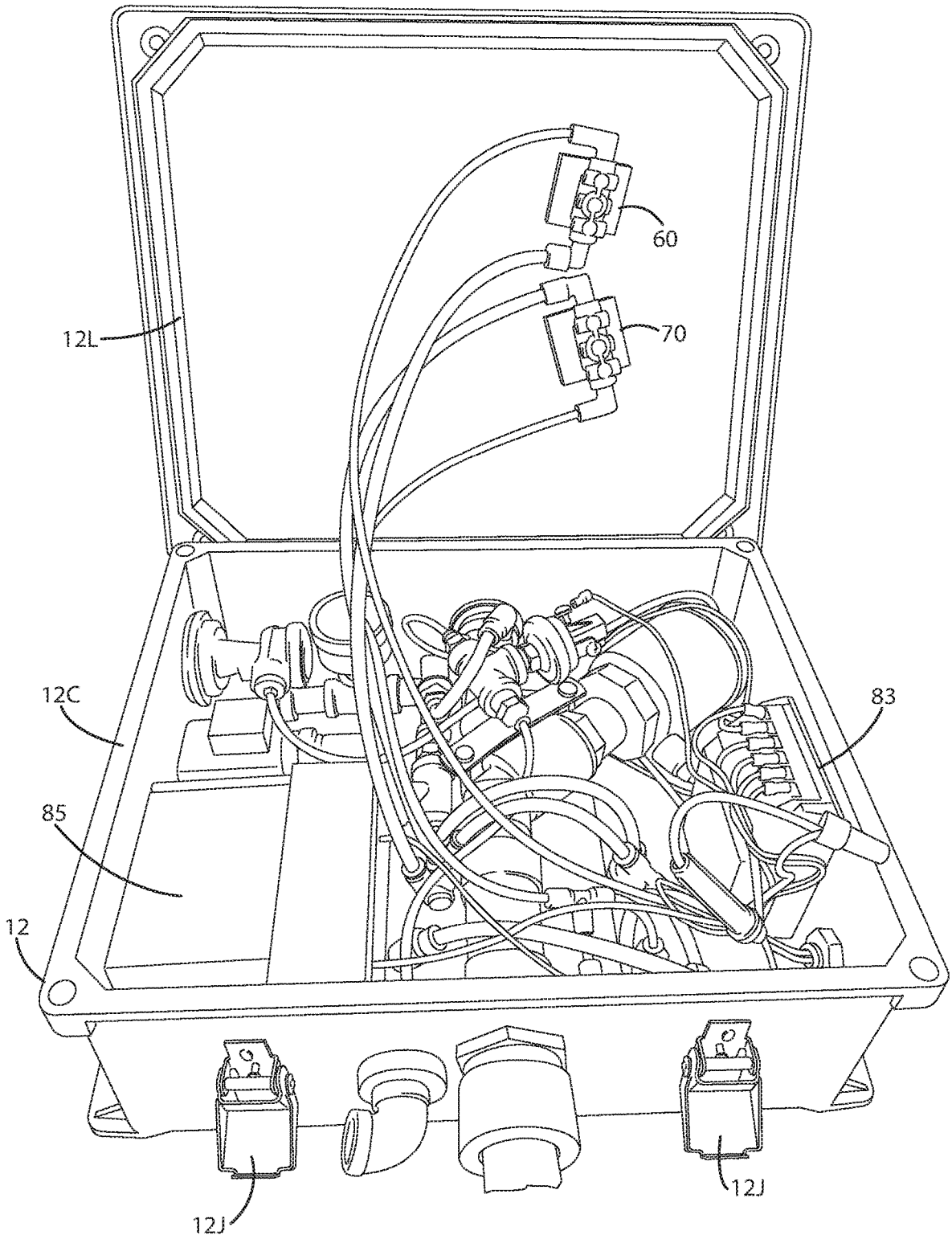
FIG. 4C is a perspective view of a housing of the system that encases multiple components.

As mentioned above, the system can include a housing 12 to protect components described below the system. The housing 12 can be in the form of a metal, polymeric or composite box with sealed apertures defined to allow the various conduits to extend from the housing to the components of the system. The housing also can define apertures or areas that allow the respective buttons or switches of the valves as described below to project outward therefrom, through the housing in a sealed manner, thereby allowing manual actuation of those items while a majority of the components are housed inside the housing. The housing can include a lid 12L that opens and closes relative to a case or enclosure 12C as shown in FIG. 4C. The lid can be secured and clamped against the case in the closed position via a system of latches 12J or other closure mechanisms. The lid can include a gasket 12G that effectively forms an air and/or water tight seal between the case and the lid. This can be helpful in applications where the housing is subject to occasional wash down, heavy rain, and/or where a pressurized stream of water is used near the system and/or the tanks to which the system is connected.

Optionally, the housing can be rated as at least a Type 4 NEMA (National Electrical Manufacturers Association of Rosslyn, Va.) housing, as approved by NEMA Enclosures Section, November 2005. In this case, the housing can be an enclosure constructed for either indoor or outdoor use to provide a degree of protection to personnel against access to hazardous parts; to provide a degree of protection of the equipment inside the enclosure against ingress of solid foreign objects (falling dirt and windblown dust); to provide a degree of protection with respect to harmful effects on the equipment due to the ingress of water (rain, sleet, snow, splashing water, and hose directed water); and that will be undamaged by the external formation of ice on the enclosure.

Further optionally, the housing 12, when closed and sealed for example with the gasket, can be pressurized with a positive air pressure on or in the enclosure of optionally at least 0.1 psi, and further optionally at least 0.3 psi. The housing can be pressurized via a pressure regulator mounted inside the housing that is in fluid communication with the air source. The housing can include rubber, elastomeric and/or polymeric seals around all the items extending from the lid and/or enclosure to facilitate a level of air tightness. The housing also can be outfitted with a vent and/or bleeder valve to allow the air inside the enclosure to be turned over at a rate of optionally at least 1.0 volumes of the enclosure per minute, further optionally at least 1.7 volumes of the enclosure per minute, and even further optionally at least 2.0 volumes of the enclosure per minute. Of course, other air turnover rates can be utilized depending on the application and job site. In some applications, the housing can include a bleeder valve with an associated gauge set at a predetermined SCFH (Standard Cubic Feet per Hour, ft3/minute at standard conditions, for example, 1 atm=14.7 psi, 68° F.), for example, optionally between 20 SCFH and 50S CFH, further optionally between 25 SCFH and 35 SCFH, and even further optionally 32 SCFH, when measured with a pressure gauge in fluid communication with the bleeder valve.

Even further optionally, where the system is outfitted with a light and controller as described in connection with the embodiments below, a controller 83 and power source 85 can be housed in the housing, and generally sealed from the surrounding environment therein.

The system 10 can include a first air mechanical valve 60. This first air mechanical valve 60 can be configured to start and/or reset the system so that the tank valve 50 opens when subjected to pressurized air communicated from the air source 40. This in turn allows the system to continue pumping liquid into the trailer tanker 20T. The first air mechanical valve 60 can be in fluid communication with the first branch 41 of pressurized air, and an intermediate conduit 61 that is in further communication with the air pilot valve 30.

The first air mechanical valve 60 can be disposed in and substantially concealed by the housing 12. The first air mechanical valve can be coupled to the second branch 42 of the pressurized air source conduit 43 and a first intermediate conduit 61. The first intermediate conduit 61 can be in selective fluid communication with the air pilot valve 30. The first mechanical valve 60 can be normally closed so that pressurized air cannot be communicated from the second branch of the pressurized air source conduit to the first intermediate conduit.

As mentioned above, the first air mechanical valve 60 can include a manual actuator 64. The manual actuator is configured to be manually engaged by a human operator so that the first air mechanical valve opens. The manual actuator can be a pushbutton, toggle switch, lever, dial, knob or other type of actuator. The first air mechanical valve is a normally closed valve, so that actuation of the actuator opens the valve whereby pressurized air can be selectively communicated from the second branch 42 of the pressurized air source conduit to the first intermediate conduit 61 and further the air pilot valve 30. This, in turn, can open the tank valve conduit 44 which is in fluid communication with the tank valve 50. With the tank valve 50 open, liquid can be transferred through the supply line 25 to the trailer tanker 20T.

As shown in FIG. 1, the system 10 can include a second air mechanical valve 70, which can be disposed in and substantially concealed by the housing. The second air mechanical valve 70 can include a manual actuator 74, similar to the manual actuator 64 above. The second air mechanical valve 70 can be in fluid communication with a second intermediate conduit 72 which is in further selective fluid communication with the air pilot valve 30. The second air mechanical valve 70 can further be coupled to the pressurized air source conduit 43. Like the first mechanical valve, the second mechanical valve can be normally closed so that pressurized air cannot be communicated from the pressurized air source conduit to the air pilot valve.

The second air mechanical valve 70 can be actuated via the manual actuator so that the second air mechanical valve opens and so that pressurized air can be selectively communicated from the pressurized air source conduit 43 to the second intermediate conduit 72, and to the air pilot valve 30. When this occurs, the air pilot valve 30 stops the pressurized air from being communicated to the tank valve 50. As a result, the tank valve, which is normally closed, has no pressurized air to keep it open, so it closes. Thus, the flow of liquid through the supply line 25 to the trailer tanker 20T ceases. To reverse this cessation of flow, and the attendant fill stoppage, the first air mechanical valve 60 can be actuated to start the flow of liquid into the trailer tanker 20T as described above.

The system 10 also can be constructed to include the above mentioned tank valve 50. This tank valve can be a normally closed pneumatically operated tank valve. One suitable tank valve is the Bi-Torq butterfly valve, which is commercially available from Bi-Torq Valve Automation of La Fox, Ill. Of course, other types of check valves, ball valves, or the like, can be substituted for the butterfly valve. As shown in FIG. 4A, the tank valve 50 can include an actuation system 51 that is run off the pneumatics of the circuit 11 in the system 10. The butterfly valve can be disposed in line with a tank valve pipe 53. This tank valve pipe optionally can be in the form of a T pipe. The top of the T can couple and can be aligned with the supply line 25, between it and the tank inlet 221. The stem 54 of the T can extend at an angle transverse to the direction of flow path F when the trailer tanker 20T is being filled. Optionally, the pipe 53 can be outfitted with a first manual valve 55. This first manual valve can enable an operator to manually rotate the lever and close the first manual valve in case the system 10 fails. The pipe also can include a second manual valve 56. Optionally, the second manual valve 56 can be manually actuated to drain residual liquid in the pipe after the supply line and the tank valve are disconnected from the tanker inlet 22. This can prevent unwanted spillage of liquid from that unit onto the ground below. Alternatively, the second manual valve can be used to open the T pipe to another line that is connected to a vacuum truck.

The system 10 can include an air horn 13 in fluid communication with the air pilot valve 30. The air pilot valve 30 usually keeps closed an internal valve in fluid communication with the air horn conduit 15 so that the air horn does not sound. When, however, the float switch 20 is actuated, the air pilot valve 30 will let off exhaust air through the air horn 13 to provide an audible warning to the operator of the system indicating that the tank is full. Of course, other types of audible alarms can be utilized. Further, as discussed in connection with the embodiments further below, visual alarms, such as strobe lights and sirens and the like can be utilized to provide an alarm in an otherwise noisy work environment.

Depending on the application and the configuration of the components, other items can be included in the system 10. For example, filters can be utilized to prevent contamination of sensitive valves, such as the float switch and the air mechanical valves. Pressure regulators also can be utilized to ensure that pumps or other devices in the system are not inadvertently operated or run.

The various modes of operation of the system 10 will now be described. To begin, FIG. 1 illustrates a standard filling or fill mode. As noted above, this filling mode can be initiated for each of multiple trailer tankers to which the supply line 25 is sequentially attached. In this mode, the tank valve 50 is hooked up manually to a trailer tanker inlet 221. An operator also can climb atop the upper wall 24 of the trailer tanker 20T and install the float switch 20. When the float switch is installed, it can be modified to work with the particular trailer tanker 20T. For example, the adjustable arm 27 can be adjusted in length (increased or decreased in length) to set the float 22 at a predetermined level extending downward from the port 23 and into the tank. This predetermined level can correspond to the maximum capacity MC of the trailer tanker so that the trailer tanker can be filled to that maximum capacity, corresponding to the maximum weight that the trailer tanker can all safely, and efficiently transport the liquid.

To calculate the maximum capacity MC, an operator can perform analysis of the liquid to be filled into the trailer tanker. Optionally, the maximum capacity of a particular trailer tanker can be less than the total volume of liquid that the trailer tanker can carry when completely full to the port 23. When multiple sequential trailer tankers are utilized, each of the trailer tankers can be evaluated to calculate the maximum capacity MC and the respective predetermined level of liquid associated with each respective maximum capacity. Thus, multiple levels of liquid and maximum capacities in weight, unique to each of the trailer tankers can be calculated. Further, the below steps can be repeated for each of multiple trailer tankers that may be sequentially loaded using the system 10. To do so, and to optionally fill the respective trailer tanker, the operator can perform the following steps in Table 1.

TABLE 1

| | |
|---|---|
| 1 | The source 5 containing the liquid can be agitated and a sample taken from the source 5. |
| 2 | An onsite test can be run on the sample to determine the solids and water content. |
| 3 | The sample can be drawn and the weight in pounds per gallon can be determined using a Fann Mud balance Model 140. |
| 4 | An assumption can be made that the liquid is a particular weight in pounds per gallon and that the trailer tanker is rated for a maximum net weight available of a certain number of pounds. |
| 5 | The operator can check a strapping chart for the trailer tanker and determine how many inches of liquid can be loaded into the trailer to provide a certain number of gallons of the liquid having the particular weight in pounds per gallon. |
| 6 | As a nonlimiting example of items 4 and 5, an assumption can be made that a liquid is 7.5 pounds per gallon in the maximum net weight available is 45,538 pounds. From the strapping chart of a particular trailer loading it to 52 inches will provide 6,072 gallons of 7.5 ppg oil, which can equate to an exemplary maximum capacity MC of the trailer tanker. Of course, depending on the weight of the liquid, the strapping chart of the particular trailer tanker, these predetermined levels and maximum capacity can vary. |
| 7 | The operator can determine the maximum height of liquid inside tank of the trailer tanker. Taking into account the predetermined level in the load in inches, the operator can vertically adjust the adjustable arm or otherwise move the location of the float to set it at the predetermined level corresponding to the maximum capacity MC of the trailer tanker. |
| 8 | The operator can install the float switch 20 as set up above through the port 23 in the upper wall 24 of the trailer tanker 20T. |
| 9 | The operator can connect the tank valve 50 and the supply line to the inlet 22I, and any corresponding valve associated therewith. |
| 10 | The operator can start the pump 26 so that liquid flows through the supply line 25, the tank valve 50, the inlet 22I and into the trailer tanker 20T so that the liquid level LL increases and approaches the float 22. This continues until the float switch stops the flow of liquid, or an operator actuates the air mechanical valve 70 to shut down the system. |

With regard to the particular modes, FIG. 1 illustrates a filling mode. In this mode, the trailer tanker 20T is filling but has not reached maximum capacity MC; instead, the liquid level LL is at some level below the float 22. In this case, the float switch 20 is closed and the first mechanical valve 60 is closed. Pressurized air is provided via the source 40 of pressurized air through the first branch 41 of the pressurized air conduit 43. This air is communicated through the air pilot valve 30 and through tank valve conduit 52. Upon the communication of the pressurized air to the tank valve 50, the tank valve, which can be normally closed, thereby opens. When it opens, liquid being pumped by the pump 26 through the supply line 25 starts and continues to flow through the tanker inlet 221 and into the trailer tanker 20T. This filling continues until one of the other modes begins.

In the filling mode, the conduits of the circuit 11 are filled with pressurized air as shown by the broken lines. Because the first air mechanical valve 60 and second air mechanical valve 70 are normally closed, the pressurized air does not flow through them. The pressurized air, however, does flow through the conduit 52 to the tank valve 50 and to the float valve 20. Again, because the float switch 20 is normally closed, the pressurized air does not go downstream of the float switch 20. The method of implementing the filling mode can include the above noted steps and conditions.

The system 10 is also operable in an automatic float switch shut off mode or filled mode shown in FIG. 2. In this mode, the trailer tanker 20T has been filled to a maximum capacity MC such that the float 22 floats in the liquid, thereby opening the float switch 20 so that the pressurized air can be communicated from the float switch inlet air conduit 28 to the float switch outlet air conduit 29 when the liquid attains a predetermined volume or predetermined level, for example, a calculated or estimated maximum volume or level at which liquid in the tank is nearing or at a maximum volume, capacity or level. When this occurs, the pressurized air is communicated to the air pilot valve 30 to shut off pressurized air to the tank valve conduit 52. As a result, the tank valve 50 returns to its normally closed configuration and effectively closes so that liquid no longer flows through the supply line into the trailer tanker inlet 221. The method of implementing the tanker filled mode can include the above noted steps and conditions.

Where an air horn 13 is in communication with the air pilot valve 30, the air horn can blow upon the trailer tanker achieving the maximum capacity MC via exhaust air escaping through the air pilot valve 30 for several seconds or longer depending on the amount of exhausted air from the system. This can alert the operator to this condition so that they can disconnect system and hook up to another trailer tanker for further loading.

Figure 3:
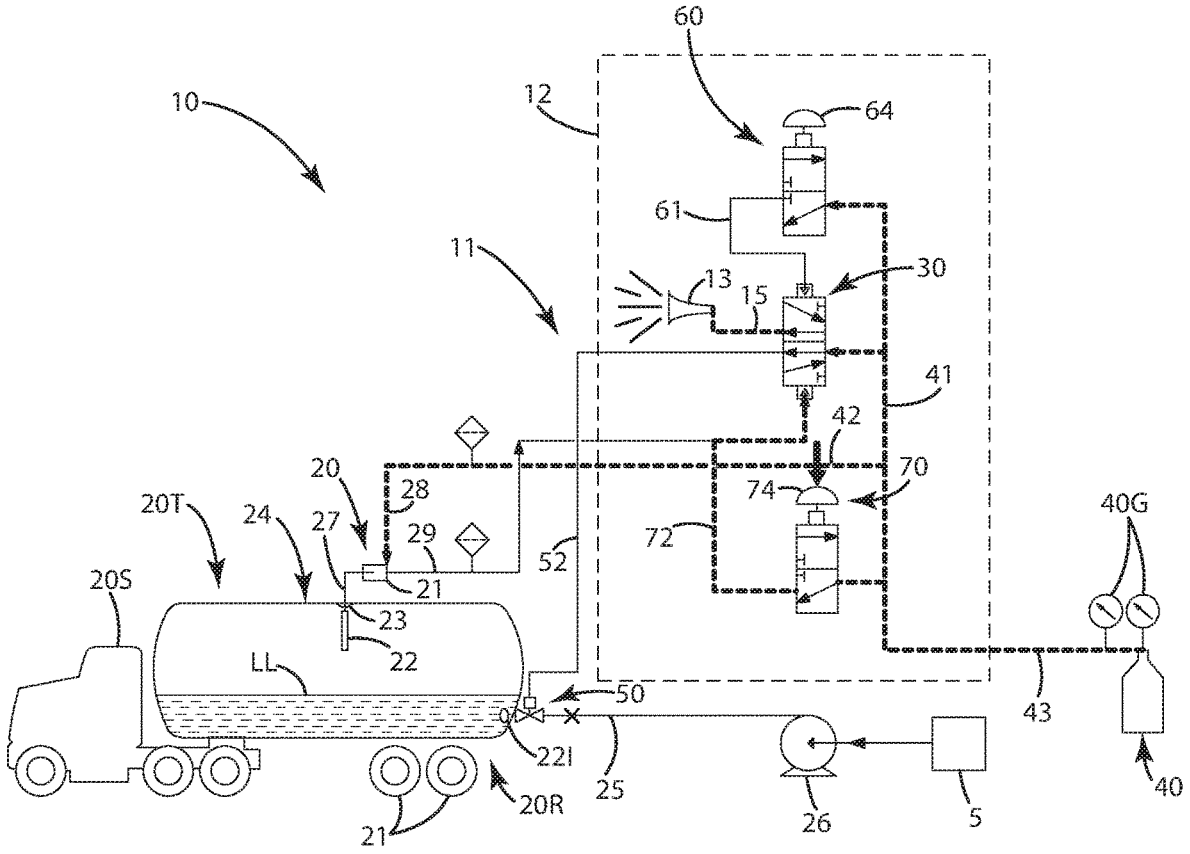
FIG. 3 is a schematic diagram of the system utilized in connection with the trailer tanker with the system in a manual emergency shut off mode.

Optionally, the system 10 also can be operable in a manual emergency shut off mode, as illustrated in FIG. 3. It may be desirable to cease pumping liquid into the trailer tanker or some other tank, for example, due to an inadvertent overfill or a line leak. Accordingly, an operator can depress or otherwise actuate the second air mechanical valve 70 as shown by the arrow. Again, the second air mechanical valve coupled to a second intermediate conduit 72 which is in further in selective fluid communication with the air pilot valve 30. The second air mechanical valve 70 opens so that pressurized air can be selectively communicated from the pressurized air source conduit 43 to the second intermediate conduit 72 and the air pilot valve 30. The air pilot valve 30 stops the pressurized air from being communicated to the tank valve 50 so that the tank valve attains its normally closed configuration and effectively closes. Thus, liquid stops flowing to the supply line 25 and into the trailer tanker 20T. Optionally, pressurized air exhausted from the air pilot valve 30 can be transferred to the air horn 13 and optionally activate that air horn for a few moments.

In the manual emergency shut off mode, the conduits of the circuit 11 are filled with pressurized air as shown by the broken lines. Because the second air mechanical valve 70 is open, as mentioned above, the pressurized air flows through it to the air pilot valve 30 thereby discontinuing the communication of pressurized air to the tank valve 50. The method of implementing the manual emergency shut off mode can include the above noted steps and conditions.

Further optionally, system 10 also can be operable in a manual reset mode as illustrated in FIG. 4. This reset mode can be initiated after the emergency manual shut off mode mentioned above, or at any other time when the system shuts down and liquid is no longer being pumped into the trailer tanker or some other tank. In this mode, an operator can manually actuate the button 64 by pushing on it in the direction of the arrow. Accordingly, the first air mechanical valve 60 opens so that pressurized air can be communicated from the second branch 41 of pressurized air source conduit to the first intermediate conduit 61 and the air pilot valve 30. As a result, the air pilot valve opens so that pressurized air can be conveyed to the tank valve conduit to open the tank valve 50, reversing it from its normally closed configuration. When the tank valve opens, this allows liquid to flow through the supply line into the trailer tanker inlet.

In the manual reset mode, the conduits of the circuit 11 are filled with pressurized air as shown by the broken lines. Because the first air mechanical valve 60 is open, as mentioned above, the pressurized air flows through it to the air pilot valve 30, thereby establishing communication between the air source 40 and the tank valve 50 to open the tank valve. The method of implementing the reset mode can include the above noted steps and conditions.

Of course, depending on the operating parameters, safety protocol and field conditions, the system 10 can be modified so that it operates in only two or three modes. For example, the first and second air mechanical valves can be removed so that the system is not operable in the emergency shut off mode or the manual reset mode. Further, the system can be plumbed to include other pneumatic components so that it can operate in other various modes, depending on the particular application.

After a particular trailer tanker 20T has been filled, the system can be removed from that first trailer tanker and installed on another second trailer tanker. For example, after the first trailer tanker is filled to a first maximum capacity, an operator can remove the tank valve from communication with the first tank inlet and remove the float switch from the port 23. The float switch thereafter can be reused and installed on the second tanker, through a similar port. The float of the float switch can be disposed inside the second trailer tanker at a second level corresponding to a second maximum capacity of the second trailer tanker. Where the volumes and capacities of the first trailer tanker and the second trailer tanker differ, the maximum capacity the first trailer tanker can be different from the maximum capacity of the second trailer tanker. Likewise the fill levels to achieve these maximum capacities in the respective trailer tankers can vary. Again, with the adjustable length connecting rod of the float switch, the float can be adjusted up or down to match and otherwise accommodate the respective levels of liquid to be filled in different sized tankers and their respective maximum capacities.

A first alternative embodiment of the system is illustrated in FIGS. 5-8 and generally designated 110. This system and the related methods can be suitable for stationary tanks 120T, such as frac tanks, storage tanks, and/or mix tanks that are used on job sites associated with the cleaning of oil and petroleum processing equipment. This embodiment is similar in structure, operation and function to the embodiments described above with several exceptions. For example, this system can include an air operated pump 126 rather than the combustion pump as with the embodiment above. The air operated pump 126 effectively pumps liquid from a source 106 of liquid to the mix tank 120T through the supply line 125 within which a tank valve 150 is disposed. The system also includes an air source 140 that is in the form of an air compressor. This air compressor generates the pressurized air to selectively run the air operated pump 126 as described further below. The air operated pump is installed in the supply line joined with the tank inlet 1221 of the tank 120T.

The system 110 can be outfitted with a first air mechanical valve 160, an air pilot valve 130 and a second air mechanical valve 170 constructed similar to those in the embodiment above. The system, however, also can include an air manifold 180 that is in fluid communication with the float switch 120, the first air mechanical valve 160, the second air mechanical valve 170 and the air pilot valve 130. These components, and the ones noted below, can be housed in a sealed housing 112, similar to that described in connection with the embodiment above.

The system 110 further can include a normal open pneumatic air supply valve 190 that is disposed between the air compressor 140 and the air operated pump 126. A check valve 192 also can be disposed in the related circuit leading to the air pump 126. In addition, the system can include one or more filters/regulators 193 and gauges 194 to monitor the pressure in various portions of the circuit of the system 110. In some cases, the system also can be outfitted with a pressure relief system or valve 196.

In addition to the air horn alarm 113, this embodiment can include in a pneumatically operated pressure switch 182 in the air circuit 111. This pressure switch can be coupled to a controller 183. The controller 183 can be electrically coupled to a light 184. The light 184 can be in the form of a strobe, lamp or other type of visual light emitting alarm. The controller also can be coupled to a battery 185 that can power the light 184. The controller and power source can be housed in the housing 112 similar to that mentioned above. Further optionally, the controller 183 can be coupled to a solar panel 186 that can consistently charge the battery 185. With this additional system, when the tank valve 150 is closed and/or the air operated pump 126 is shut off, in any respective mode, the pressure switch 182 can be actuated in which case the light 184 goes off to alert the operator or others in the area that the tank has reached an overfill condition or some maximum capacity, or that the air pump 126 has ceased operation. Due to the noisy environment where these types of tanks are utilized, this can be helpful in addition to any audible alarm emitted by the air horn 113. Optionally, the light 184 can include a magnetic base 184B so that it can be secured to a metal structure in an area that is visible to many crew members that may be working with the operator.

Figure 8:
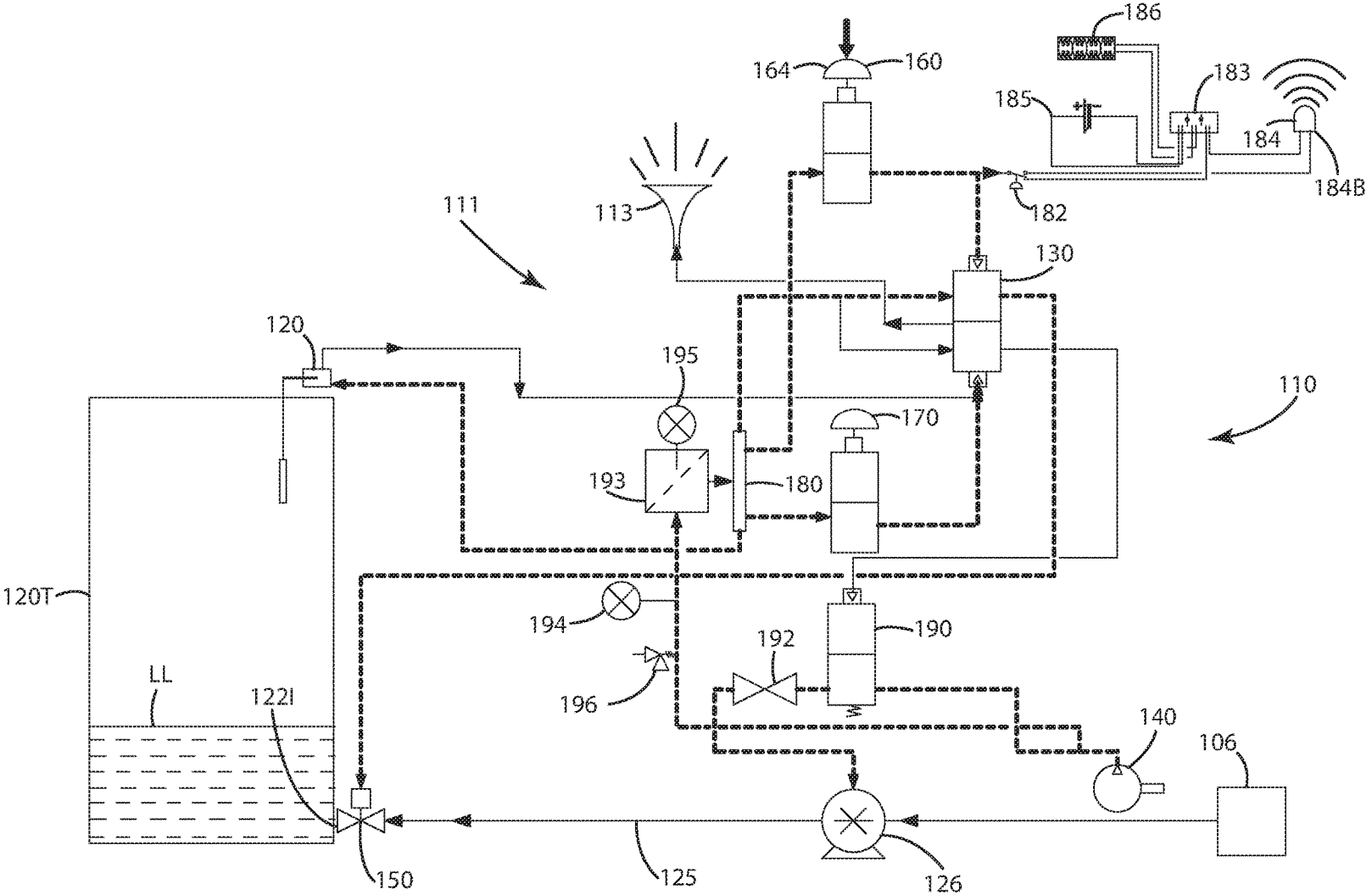
FIG. 8 is a schematic diagram of the system utilized in connection with the tank, with the system in a manual reset mode, or reset mode.
Figure 8A:
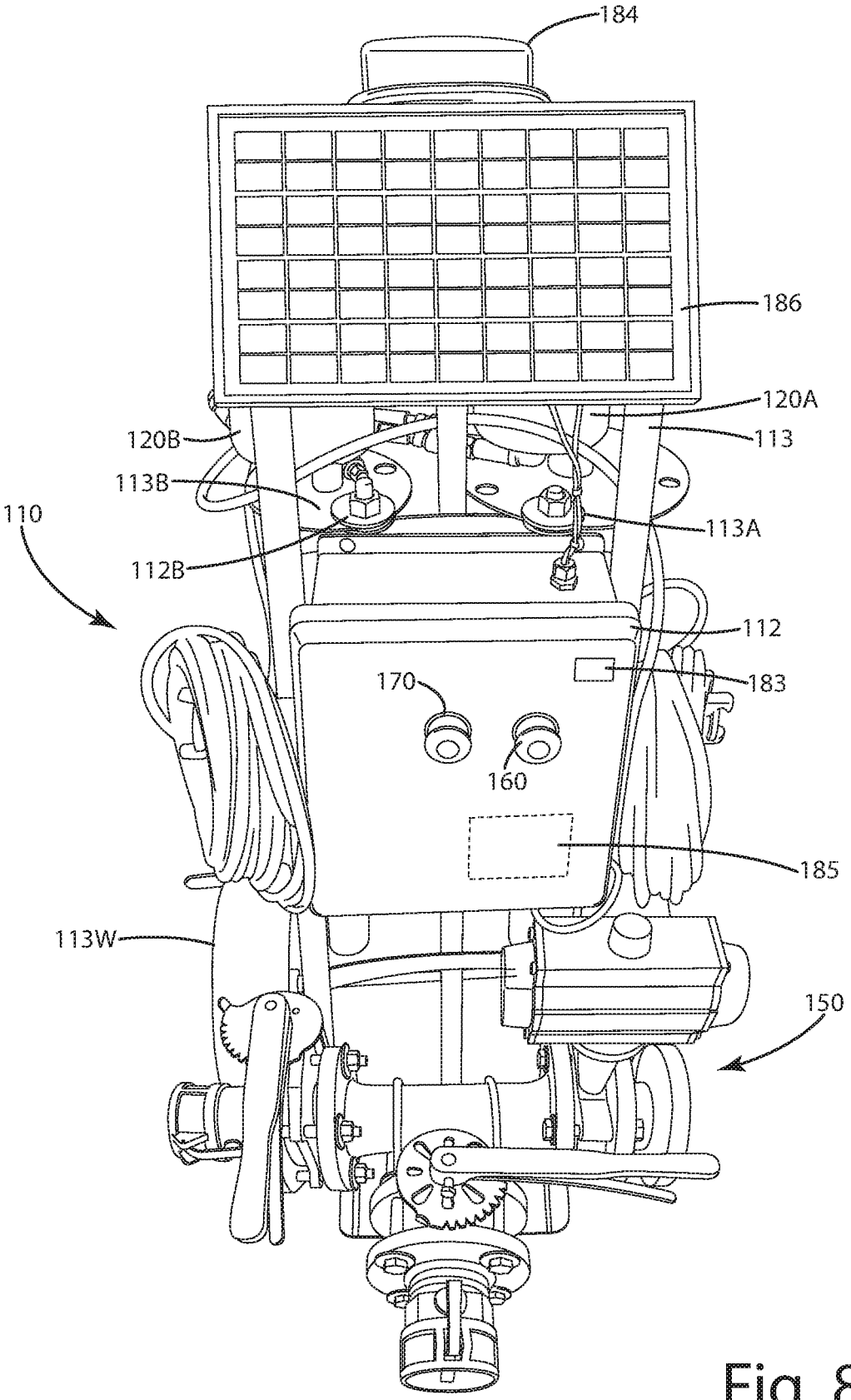
FIG. 8A is a perspective view of a portable version of the system mounted on a wheeled apparatus.
Figure 8B:
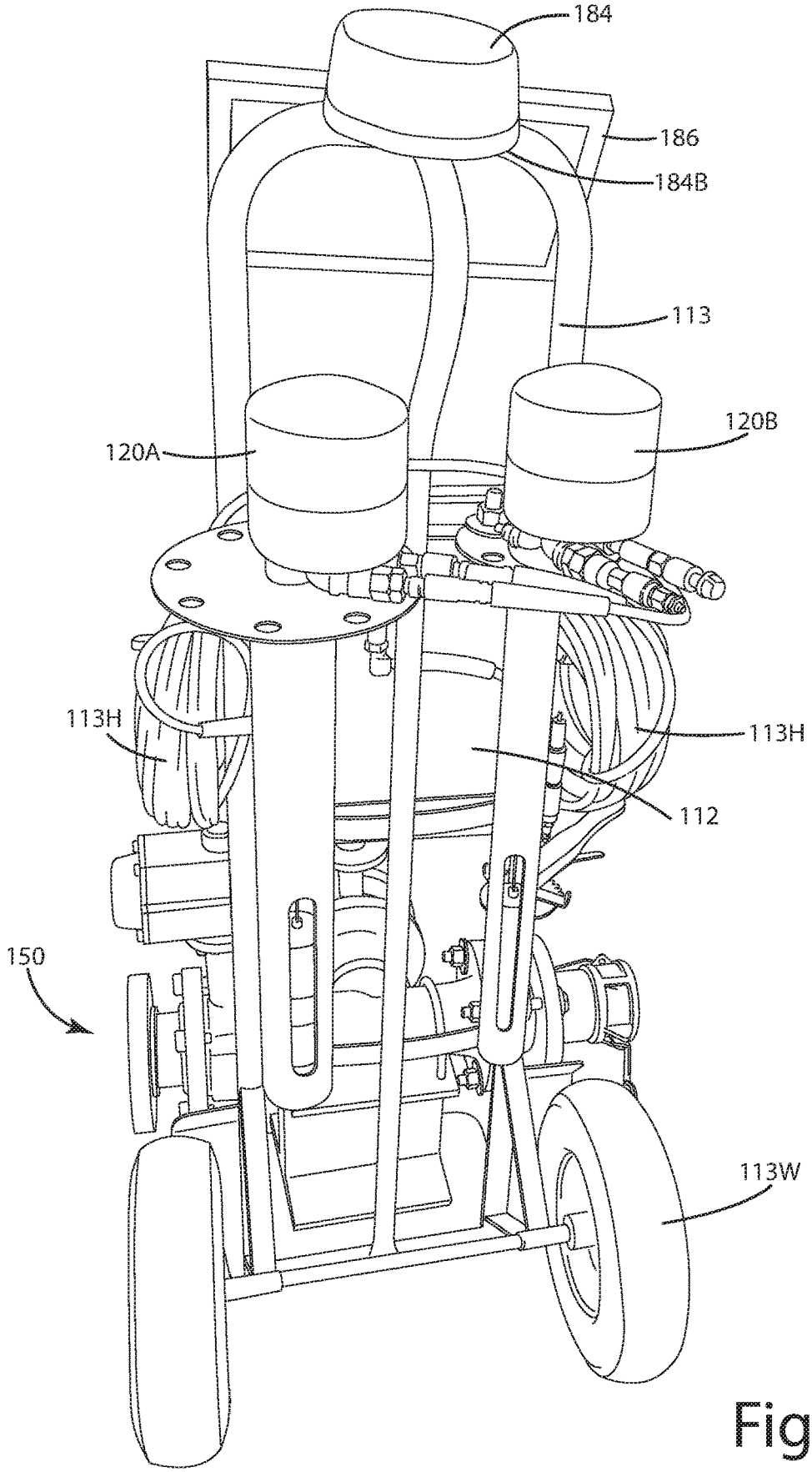
FIG. 8B is a rear perspective view of the portable version of the system.

In some applications, the system 110 can be mounted on a portable carrier 113, as shown in FIGS. 8A and 8B. The portable carrier 113 optionally can be in the form of a dolly, a cart, or some other wheeled carrier including one or more wheels 113W. The housing 112 can be secured to the carrier via brackets or some other connector 112B. The solar panel 186 also can be mounted to the carrier, for example at the top thereof. The light 184 can include the magnetic base 184B, as mentioned above, and can be magnetically but removably joined with the carrier so that the light can be placed in an area at the worksite having high visibility. In addition, the carrier can be constructed to carry the tank valve 150, which can be similar to and can include the same components as the tank valve 50 illustrated in FIG. 4A above. Optionally, the tank valve 150 can be mounted low on the carrier, near the wheels for example. This is so that the carrier will not be top-heavy so that it easily topples over. Because the tank valve and its components can be quite heavy, a wheeled carrier can make transport and connection of the tank valve to supply lines, tank inlets, vacuum trucks and the like relatively easy.

The carrier 113 also can be set up to accommodated different types and/or sizes of float switches 120A, 120B, which can be used in connection with different types of tanks, having different upper port sizes. For example, one float switch 120A can have a sleeve with a diameter that will fit inside a 4 inch internal diameter tank port or connector. The other float switch 120B can have a sleeve with a diameter that will fit inside a 2 inch internal diameter tank port or connector. The carrier can further include brackets 113A, 113B that can hold and secure float switches 120A and 120B respectively, securing them to the carrier in a fixed, but removable manner so they can be removed and installed atop a tank.

Figure 5:
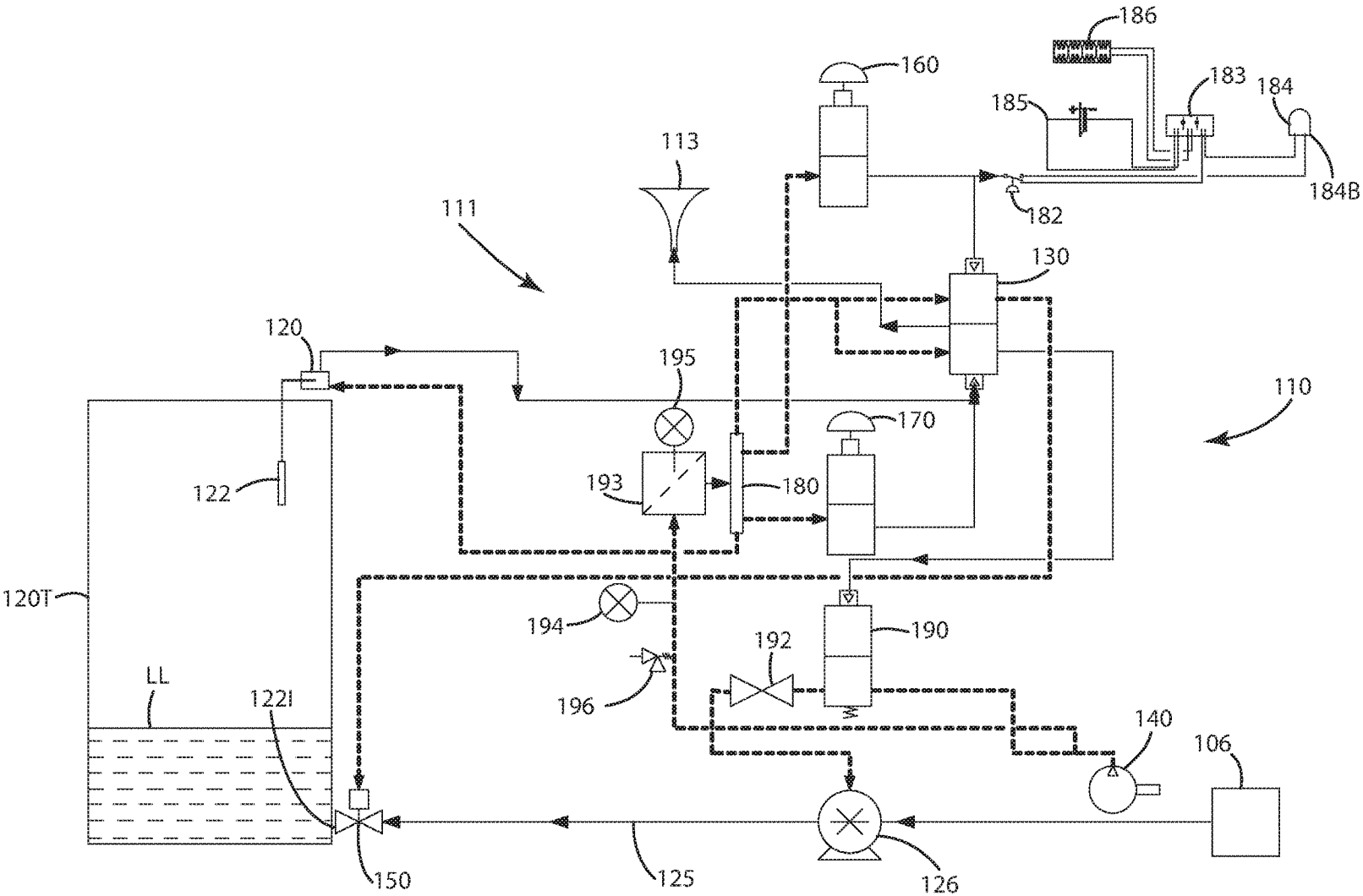
FIG. 5 is a schematic diagram of the pneumatically operated system of a first alternative embodiment utilized in connection with one or more tanks with the system in a filling mode, where the system includes an air compressor.

The various modes of operation of the system 110 will now be described in more detail. To begin, FIG. 5 illustrates the system having been fully installed relative to the mix tank 120T, that is, the air operated pump is installed in supply line in 122 and the float switch 120 is installed in the interior of the mix tank 120T. Accordingly, the air compressor is turned on so that pressurized air from the air compressor runs the air operated pump 126 to pump liquid to the supply line 125 through the open tank valve 150 and into the tank 120T of the tank inlet 1221. In this configuration, the system is in a filling mode, in which the system continues to fill the tank with the liquid. In this mode, pressurized air is communicated to the various conduits as shown in broken lines. The air compressor 140 communicates pressurized air through the normally open air supply valve 190, which is subsequently transferred through the check valve 192 into the air operated pump 126. Pressurized air also is communicated from the air pump to the regulator/filter 193 and ultimately to the manifold 180. From the manifold 180, the pressurized air is communicated to the float switch 120. This pneumatic float switch is normally closed when the float 122 is in a position shown in FIG. 5, or generally not floating in the liquid. There also is fluid communication of pressurized air to the first air mechanical valve 160 and the second air mechanical valve 170, but due to the normally closed condition of these valves, pressurized air is not communicated past them. Likewise, pressurized air is communicated to the pilot valve 130 but because it is closed, no pressurized air goes beyond that valve except to the tank valve 150 so the tank valve opens and allows liquid to flow through the supply line 125, being pumped by the pump 126 and into the tank 120T. Again, the system stays in this fill mode until one of the other modes is commenced. The method of implementing the fill mode can include the above-noted steps and conditions.

Figure 6:
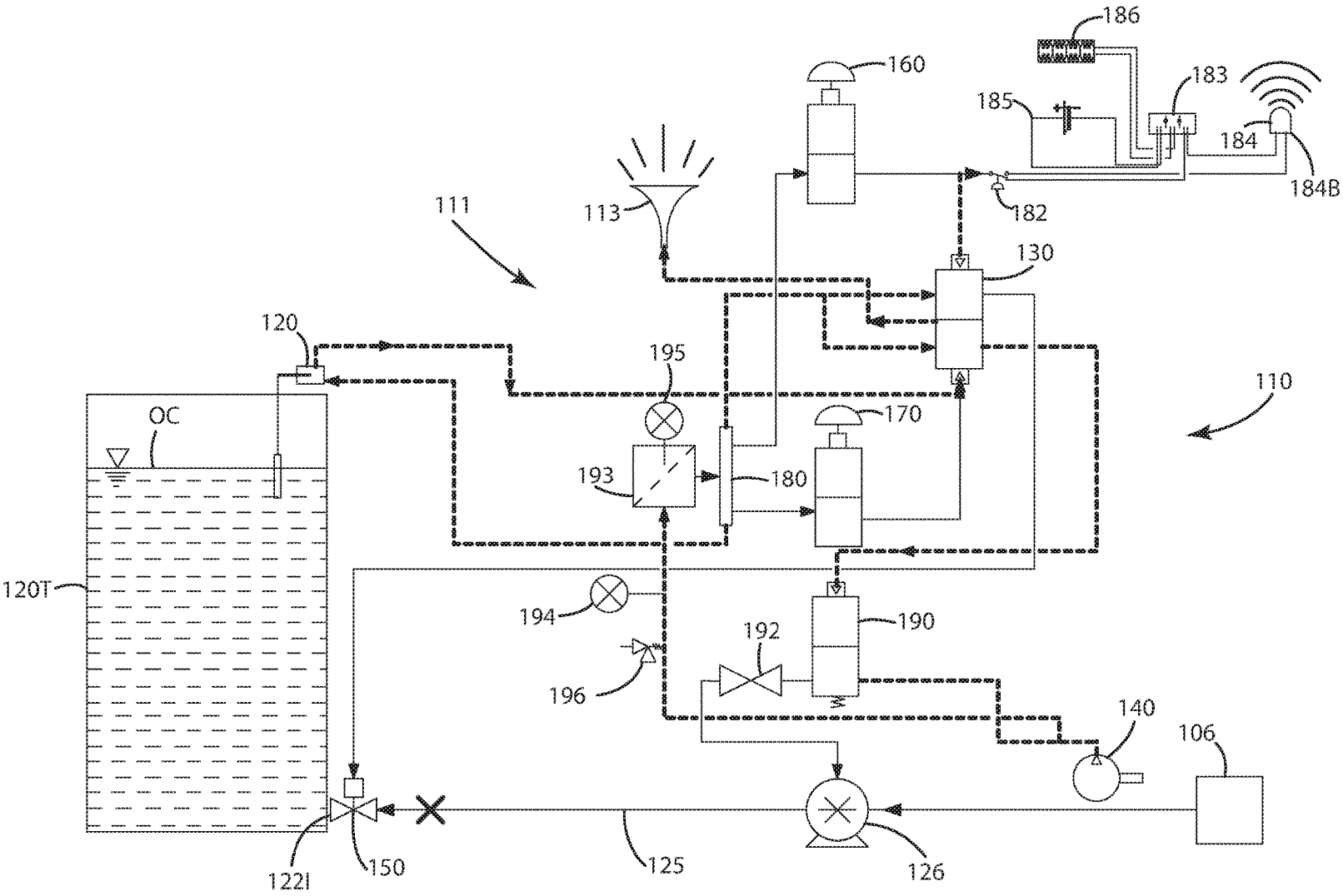
FIG. 6 is a schematic diagram of the system utilized in connection with the tank, with the system in an automatic float switch shut off mode, or filled mode.

The system 110 is also operable in an automatic float switch shut off mode shown in FIG. 6. This mode can also be referred to as a tank filled mode. In this mode, the tank 120T has been filled to a potential overfill capacity OC such that the float 122 floats in the liquid, thereby opening the float switch 120 so that the pressurized air can be communicated to the air pilot valve 130 to shut off pressurized air to the tank valve 150. As used herein, an overfill capacity can be a capacity of the tank at which the liquid in the tank is nearing, is close to and/or has reached a volume where the liquid can potentially begin to escape or leak from the tank, or otherwise cause damage to the tank or the environment, area or items around the tank. As a result, the tank valve 150 closes so that liquid no longer flows through the supply line 125 into the tank inlet 1221. In addition, the pressurized air is communicated from the air pilot valve 132 to the normal open air supply valve 190. As a result, the normal open up air supply valve 190 closes, in which case air is no longer communicated to the air operated pump 126. Thereafter, the air operated pump 126 ceases pumping liquid to the supply line 125 into the tank inlet 1221. In addition, the air pilot valve 130 communicates exhaust air to the air horn 113 and sounds an audible alarm. In addition, the air pilot valve can communicate air pressure to the pressure switch 182. As a result, the controller senses the pressure change and actuates the light 184. The aforementioned actions can provide audible and visual indication to operators and crew members that the tank is full. At that point, the operator can determine what to do with the system and the mix tank. The method of implementing the filled mode can include the above-noted steps and conditions.

Figure 7:
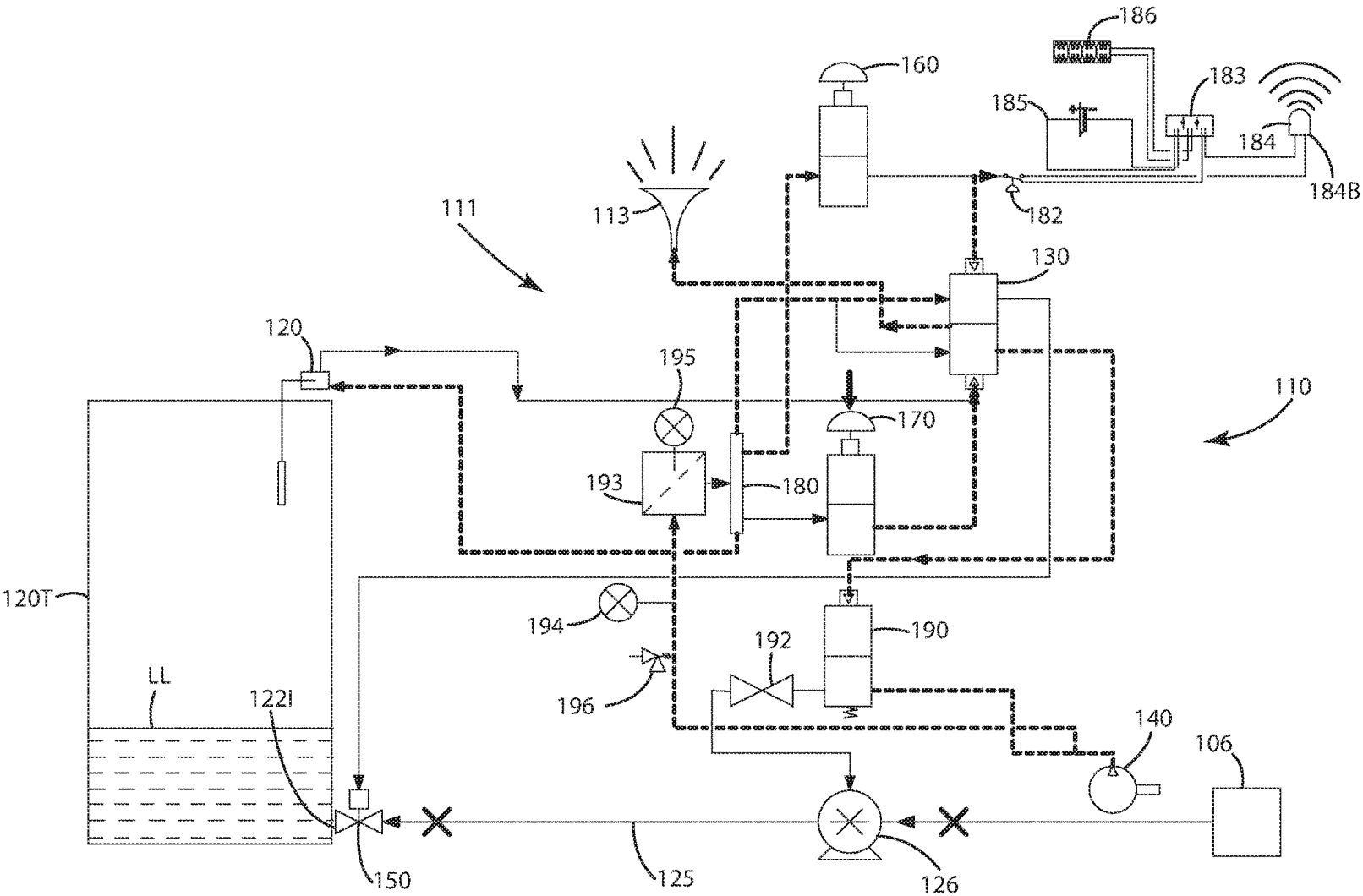
FIG. 7 is a schematic diagram of the system utilized in connection with the tank, with the system in a manual emergency shut off mode.

Optionally, the system 10 also can be operable in a manual emergency shut off mode as illustrated in FIG. 7. In this mode, an operator can manually engage the pushbutton of the second valve 170 as shown with the large arrow. This can be done during a period after the tank was filling with the liquid and before the overfill capacity OC is achieved in the tank. This second air mechanical valve is disposed between and in fluid communication with the air compressor 140 and the air operated pump 126. As shown in broken lines, the air pilot valve 130 is actuated so that the air horn 113 goes off and the strobe light 184 also goes off. In addition, pressurized air is communicated to the normally open air supply valve 190, thereby closing that valve ends ceasing pressurized air from being communicated to the air pump 126. In turn, the air pump shuts off no longer pumping liquid through the supply line 125. In addition, communication of pressurized air from the air pilot valve 132 to the tank valve 150 ceases. The tank valve thereby closes under the action of an internal spring. With the air pump off and the tank valve closed, liquid ceases entering the tank 120T.

Further optionally, the system 110 can be operable in a manual reset mode, also referred to as a reset mode, as illustrated in FIG. 8. This reset mode can be initiated after the emergency manual shutoff mode mentioned above, or at any other time when the system shuts down and liquid is no longer being pumped into the tank. In this mode, an operator can manually actuate the button 164 by pushing on it in the direction of the arrow. Accordingly, the first air mechanical valve 160 opens so that pressurized air can be communicated to the air pilot valve 130. As a result, the air pilot valve ceases transfer of pressurized air to the normal open air supply valve 190, in which case pressurized air from the air compressor is conveyed to the air pump 126 to run the pump and pump the liquid in the supply line 125. In addition, the air pilot valve 130 provides fluid communication of the pressurized air to the tank valve 150, thereby opening that normally closed tank valve 150 to allow the liquid to pump through it and to the tank 120T. Accordingly, the tank resumes filling.

Figure 9:
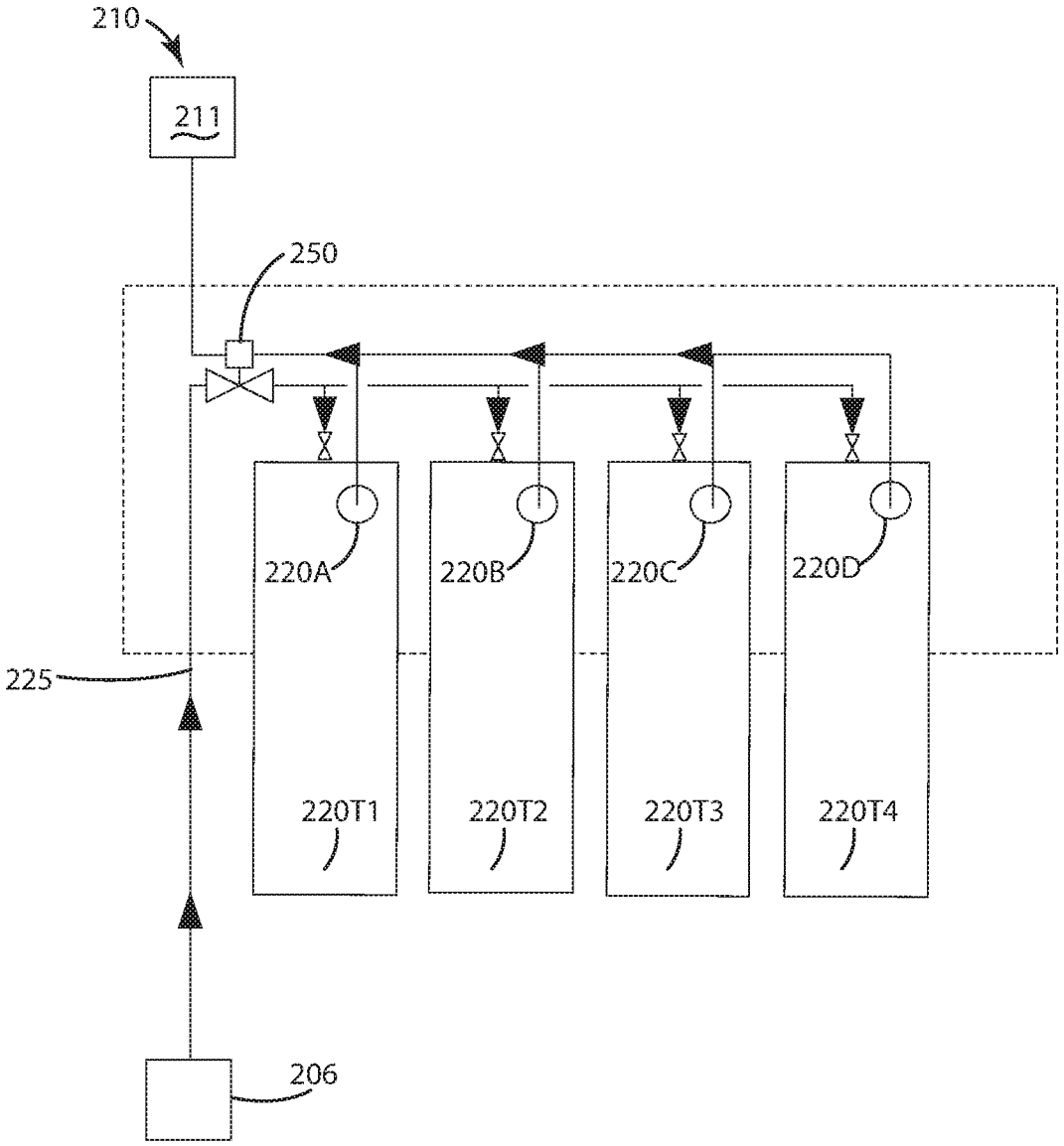
FIG. 9 is a schematic diagram of the system utilizing multiple float switches in multiple mixed tanks.

A second alternative embodiment of the system is shown in FIG. 9 and generally designated 210. The system is similar to the embodiments above in structure, function and operation with several exceptions. For example, the system can include an air circuit 211 and is plumbed to the various components of the first alternative embodiment shown in FIG. 8. However, with this configuration, the tank valve 250 is coupled between a supply line 225 that feeds multiple mix tanks 221, 222, 223 and 224. Each of these mix tanks is outfitted with its own respective float switch 220A, 220B, 220C and 220D. These float switches are all in fluid communication with the circuit 211 and the various components described in connection with the embodiment immediately above. With this alternative system 210, the various tanks can be simultaneously or sequentially filled. When, however, any of the tanks achieve a predetermined level associated with a maximum capacity and/or an overfill capacity, and any single one of the float switches 220A, 220B, 220C or 220D are individually tripped, that causes the system 210 to shut the tank valve 250 so that liquid is no longer conveyed from the supply line to any of the mix tanks. With this construction, it is possible to close one tank valve in a supply line via any one of four separate floats. Of course, the number of tanks and floats can be increased or decreased, depending on the project. As with the embodiments above, this system can include various modes, for example the fill mode, the automatic float switch shut off mode or filled mode, the manual emergency shutoff mode and/or a manual reset mode.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A method of filling a trailer tanker with liquid to a maximum capacity, comprising:

providing a float switch on a first trailer tanker so that a float of the float switch is disposed inside the first trailer tanker at a first level corresponding to a first capacity of the first trailer tanker, the first trailer tanker having a plurality of wheels;

providing a normally closed, pneumatically actuated tanker valve, the tanker valve being joined with a tanker valve conduit, the tanker valve configured to open when pressurized air is introduced through the tanker valve conduit;

providing a portable bottle of pressurized air;

installing the tanker valve in communication with a supply line joined with a first trailer tanker inlet of the first trailer tanker;

communicating the pressurized air from the portable bottle with the tanker valve conduit, thereby opening the tanker valve when the pressurized air is introduced through the tanker valve conduit to allow liquid to flow through the supply line into the first trailer tanker inlet, and thereby at least partially fill the first trailer tanker;

continuing to fill the first trailer tanker with the liquid;

attaining with the liquid the first capacity of the first trailer tanker, so that the float trips the float switch, thereby opening the float switch so that the pressurized air can be communicated from a float switch inlet air conduit to a float switch outlet air conduit, the pressurized air further communicated to an air pilot valve to discontinue pressurized air from being communicated to the first tanker valve conduit, such that the tanker valve closes and liquid no longer flows through the supply line into the first trailer tanker inlet.

2. The method of claim 1, comprising:

extending a down tube through a first upper tanker inlet, the float being movably disposed in the down tube, and setting the float a distance below the first upper tanker inlet at a depth corresponding to the first capacity, wherein the down tube has a diameter less than 2 inches, wherein the float has a diameter less than 1.5 inches, wherein the float weighs less than 100 grams and is buoyant in the liquid.

3. The method of claim 2, comprising:

calculating the first level of liquid in the first trailer tanker corresponding to the first capacity, which is a first maximum capacity that is less than a total volume of liquid that the first trailer tanker can contain.

4. The method of claim 3, comprising:

pumping the liquid through the supply line joined with a first trailer tanker inlet with a combustion engine pump.

5. The method of claim 1, comprising:

actuating, via a human manual engagement, a second air mechanical valve, disposed between and in fluid communication with the portable bottle of pressurized air and the tanker valve conduit, after the continuing step and before the attaining step, so that the second mechanical valve ceases communication of the pressurized air to the tanker valve conduit; and closing the tanker valve as a result of the actuating step so that liquid stops entering the first trailer tanker.

6. The method of claim 5, wherein the second air mechanical valve is in fluid communication with an air pilot valve via a second intermediate conduit, wherein the air pilot valve is in fluid communication with the tanker valve via the tanker valve conduit, wherein actuating a second air mechanical valve closes the air pilot valve so the pressurized air is no longer communicated to the tanker valve, causing the tanker valve to close so the liquid stops entering the first trailer tanker.

7. The method of claim 5, comprising:

actuating via a human manual engagement a first air mechanical valve disposed between and in fluid communication with the portable bottle of pressurized air and the tanker valve conduit, after the continuing step and before the attaining step, and after the actuating the second air mechanical valve, so as to cause communication of the pressurized air to the tanker valve conduit, opening the tanker valve as a result of the actuating step of the first air mechanical valve wherein liquid enters the first trailer tanker.

8. The method of claim 1 comprising:

removing, after the first trailer tanker is filled to the first capacity, the float switch from the first trailer tanker;

removing the tanker valve from fluid communication with the first trailer tanker inlet;

installing the float switch on a second trailer tanker, so that the float is disposed inside the second trailer tanker at a second level corresponding to a second capacity of the second trailer tanker, the second trailer tanker including a plurality of wheels;

wherein the first capacity is different from the second capacity, wherein the first level is different from the second level.

9. The method of claim 8 comprising:

adjusting a length of a rod supporting the float from a first length to a different second length to accommodate the second level, wherein removing the float switch includes sliding a down tube containing the float out of an upper tank port disposed atop the first trailer tanker, wherein the tank port has a diameter of at least 2 inches and the down tube has a diameter less than 2 inches.

10. A method of preventing overfill of a tank, comprising:

providing a float switch on a first tank so that a float of the float switch is disposed inside the first tank at a first level corresponding to an overfill capacity;

providing an air operated pump;

providing an air compressor that generates pressurized air to selectively run the air operated pump;

installing the air operated pump in a supply line joined with a first tank inlet of the first tank;

engaging the air compressor so that pressurized air from the air compressor runs the air operated pump to pump liquid through the supply line and the first tank inlet, and into the first tank;

continuing to fill the first tank with the liquid; attaining with the liquid an overfill capacity of the first tank, so that the float trips the float switch, thereby opening the float switch so that the pressurized air is communicated from a float switch inlet conduit to a float switch outlet conduit, the pressurized air being further communicated to an air pilot valve to discontinue pressurized air from being communicated to the air operated pump from the air compressor, such that the air operated pump ceases pumping liquid through the supply line into the first tank inlet;

actuating via a human manual engagement a second air mechanical valve disposed between and in fluid communication with the air compressor and the air operated pump, after the continuing step and before the attaining step, so that the air compressor ceases communication of the pressurized air to the air operated pump, so liquid stops flowing through the first tank inlet; and actuating via a human manual engagement a first air mechanical valve disposed between and in fluid communication with the air compressor and the air operated pump, after the continuing step and before the attaining step, and after the actuating the second air mechanical valve, so as to cause communication of the pressurized air to the air operated pump, wherein liquid flows into the first tank.

11. A method of preventing overfill of a tank, comprising:

providing a float switch on a first tank so that a float of the float switch is disposed inside the first tank at a first level corresponding to an overfill capacity;

providing an air operated pump;

providing an air compressor that generates pressurized air to selectively run the air operated pump;

installing the air operated pump in a supply line joined with a first tank inlet of the first tank;

engaging the air compressor so that pressurized air from the air compressor runs the air operated pump to pump liquid through the supply line and the first tank inlet, and into the first tank;

continuing to fill the first tank with the liquid;

attaining with the liquid an overfill capacity of the first tank, so that the float trips the float switch, thereby opening the float switch so that the pressurized air is communicated from a float switch inlet conduit to a float switch outlet conduit, the pressurized air being further communicated to an air pilot valve to discontinue pressurized air from being communicated to the air operated pump from the air compressor, such that the air operated pump ceases pumping liquid through the supply line into the first tank inlet;

providing a normally closed, pneumatically actuated tank valve, the tank valve being joined with a tank valve conduit, the tank valve configured to open when pressurized air is introduced through the tank valve conduit;

installing the tank valve in the supply line joined with the first tank inlet of the first tank;

communicating pressurized air from the air compressor so that the pressurized air is in fluid communication with the tank valve conduit, thereby opening the tank valve when pressurized air is introduced through the tank valve conduit to allow liquid to flow through the supply line into the first tank inlet, and thereby at least partially fill the first tank; and establishing fluid communication between a float switch outlet air conduit, an air pilot valve and a pressure switch, so that the pressure switch actuates a light so that the light emits illumination when the air operated pump ceases pumping liquid through the supply line.

12. A method of preventing overfill of a tank, comprising:

providing a float switch on a first tank so that a float of the float switch is disposed inside the first tank at a first level corresponding to an overfill capacity;

providing an air operated pump;

providing an air compressor that generates pressurized air to selectively run the air operated pump;

installing the air operated pump in a supply line joined with a first tank inlet of the first tank;

engaging the air compressor so that pressurized air from the air compressor runs the air operated pump to pump liquid through the supply line and the first tank inlet, and into the first tank;

continuing to fill the first tank with the liquid;

attaining with the liquid an overfill capacity of the first tank, so that the float trips the float switch, thereby opening the float switch so that the pressurized air is communicated from a float switch inlet conduit to a float switch outlet conduit, the pressurized air being further communicated to an air pilot valve to discontinue pressurized air from being communicated to the air operated pump from the air compressor, such that the air operated pump ceases pumping liquid through the supply line into the first tank inlet;

establishing fluid communication between the air compressor and the air operated pump via a normally open air valve; and closing the normally open air valve when an air pilot valve stops pressurized air from being communicated to the air operated pump from the air compressor.

13. A liquid tank fill system comprising:

a supply line configured for attachment to a tank inlet;

a normally closed, pneumatically actuated tank valve disposed in the supply line, the tank valve being joined with a tank valve air conduit, the tank valve configured to open when pressurized air is introduced through the tank valve conduit, thereby allowing liquid to flow through the supply line toward the tank inlet;

a float switch joined with a float switch inlet air conduit and a float switch outlet air conduit, the float switch being normally closed so that pressurized air cannot be communicated from the float switch inlet air conduit to the float switch outlet air conduit, the float switch including a float configured to float in the liquid, a first capacity, the float configured to open the float switch when the float floats in the liquid so that the pressurized air can be communicated from the float switch inlet air conduit to the float switch outlet air conduit;

a source of pressurized air joined with a pressurized air source conduit having a first branch and a second branch;

a housing, an air pilot valve disposed in the housing, the air pilot valve in selective fluid communication with the tank valve air conduit, the float switch inlet air conduit, the float switch outlet air conduit and the first branch of the pressurized air source conduit;

a first air mechanical valve disposed in the housing, the first air mechanical valve coupled to the second branch of the pressurized air source conduit and a first intermediate conduit, the first intermediate conduit in selective fluid communication with the air pilot valve, the first mechanical valve being normally closed so that pressurized air cannot be communicated from the second branch of the pressurized air source conduit to the first intermediate conduit, the first air mechanical valve including a manual actuator, which is configured to be manually engaged by a human operator so that the first air mechanical valve opens and so that pressurized air can be selectively communicated from the second branch of pressurized air source conduit to the first intermediate conduit and to the air pilot valve, wherein the system is operable in a filling mode, in which the tank is filling with the liquid but a volume of the liquid has not reached a first capacity, the float switch is closed, the first mechanical valve is closed, pressurized air is provided via the source of pressurized air through the first branch of the pressurized air conduit, through the air pilot valve, and through the tank valve conduit to hold open the tank valve, thereby allowing liquid to flow through the supply line to the tank inlet, wherein the system is operable in a filled mode, in which the tank has been filled with the liquid where the volume of the liquid has reached or exceeded the first capacity so that the float floats in the liquid, thereby opening the float switch so that the pressurized air can be communicated from the float switch inlet air conduit to the float switch outlet air conduit such that the pressurized air is communicated to the air pilot valve to shut off pressurized air to the tank valve conduit, in which case the tank valve closes so that liquid no longer flows into the tank inlet, wherein the system is operable in a reset mode, in which the manual actuator is manually actuated by an operator, the first air mechanical valve opens so that pressurized air can be communicated from the second branch of pressurized air source conduit to the first intermediate conduit and the air pilot valve so that the air pilot valve conveys pressurized air to the tank valve conduit to open the tank valve, thereby allowing liquid to flow into the tank inlet.

14. The system of claim 13, wherein the source of pressurized air is a bottle of compressed fluid configured to open the tank valve at least 50 times, wherein the tank inlet is associated with a trailer tanker mounted on a plurality of wheels, wherein the housing includes a lid and an enclosure, with a gasket between the lid and the enclosure when the housing is closed, so that the housing is sealed from water and dust in an environment around the housing.

15. The system of claim 13 wherein the source of pressurized air is an air compressor.

16. The system of claim 13 comprising:

a second air mechanical valve disposed in the housing, the second air mechanical valve coupled to a second intermediate conduit which is in further selective fluid communication with the air pilot valve, the second air mechanical valve coupled to the pressurized air source conduit, the second mechanical valve being normally closed so that pressurized air cannot be communicated from the pressurized air source conduit to the air pilot valve, wherein the second air mechanical valve includes a manual actuator which is configured to be manually engaged by a human operator so that the second air mechanical valve opens and so that pressurized air can be selectively communicated from the pressurized air source conduit to the second intermediate conduit, and the air pilot valve to thereby cease the pressurized air from being communicated to the tank valve in which case the tank valve closes.

17. The system of claim 16, wherein the float switch includes an arm coupled to the float, wherein the arm is adjustable and length so that a user can precisely set a level at which the first capacity is achieved in the trailer tanker.

* * * * *